US010231560B2

(12) United States Patent
Carlile

(10) Patent No.: US 10,231,560 B2
(45) Date of Patent: Mar. 19, 2019

(54) CONVERTABLE PILLOW AND BLANKET

(71) Applicant: Alison J. Carlile, Vineyard, UT (US)

(72) Inventor: Alison J. Carlile, Vineyard, UT (US)

(73) Assignee: NORTH FIELDS TRADING COMPANY LLC, Vineyard, UT (US)

( * ) Notice: Subject to any disclaimer, the term of this patent is extended or adjusted under 35 U.S.C. 154(b) by 0 days.

(21) Appl. No.: 15/256,877

(22) Filed: Sep. 6, 2016

(65) Prior Publication Data

US 2018/0064269 A1 Mar. 8, 2018

(51) Int. Cl.
*A47G 9/10* (2006.01)
*A47G 9/02* (2006.01)

(52) U.S. Cl.
CPC ..... *A47G 9/1045* (2013.01); *A47G 9/0223* (2013.01)

(58) Field of Classification Search
CPC ..... A47G 9/062; A47G 9/1045; A47G 9/0223
See application file for complete search history.

(56) References Cited

U.S. PATENT DOCUMENTS 5,454,125 A * 10/1995 Ratkowski ..... A47G 9/064 383/4
5,457,829 A * 10/1995 Elliott ..... A47G 9/0207 5/420
6,408,462 B1 * 6/2002 Moore ..... A41D 3/08 2/69
6,647,570 B1 * 11/2003 Ong ..... A47G 9/02 5/417
7,017,206 B1 * 3/2006 Kedineoglu ..... A45F 4/02 5/417
7,076,816 B1 * 7/2006 Nielsen ..... A47G 9/062 297/188.06
7,111,343 B1 * 9/2006 Bates ..... A45C 9/00 383/4
D658,422 S * 5/2012 Mandell ..... D6/608
2013/0189898 A1 * 7/2013 Abbott ..... A47G 9/0207 446/73

* cited by examiner

*Primary Examiner* — Eric J Kurilla
(74) *Attorney, Agent, or Firm* — Stephen E. Zweig

(57) ABSTRACT

A furniture pillow convertible to and from a personal blanket device. The device comprises a first pillow configuration with an upholstery fabric exterior, a zipper, and stuffed with a blanket attached to an interior side of the pillow. The pillow is configured so that it may be turned inside out, releasing the interior blanket. The blanket and the interior of the pillow are typically constructed using a plush fabric. The blanket may be configured with optional features such as a pockets or nooks for the user's feet and hands. Various alternative designs are disclosed.

14 Claims, 28 Drawing Sheets pillow
102 (inside the pillow)
106
104
100 blanket
112
102
120
106
104
110

20"
20"
100
106

100
106

106

100
106
106
110

106

110
208
207
206
102
3"
106
20"
16"
16"
202
72"
212
204
19"
200
14"
1"
55"
210

Upholstery fabric
302
Fabric zipper flaps
300
104

Upholstery fabric
106
2 Double headed zippers so they can be zipped from the inside or outside

106

Plush Fabric
Stich line shows through to top layer

All elements sewn to this side
Hand Nook

Plush fabric same as blanket covering hidden pillow compartment
202
200
Hand Nook
110
106

110

Edges are folded and stitched

Foot Nook
Plush Fabric

Loop side of velcro
Plush Fabric

Hook side of velcro
on underside

122
Plush fabric same as blanket covering
hidden pillow compartment
Hand Nook
120
Foot Nook
Plush Fabric

CONVERTABLE PILLOW AND BLANKET

BACKGROUND OF THE INVENTION

Field of the Invention

This invention is in the field of soft goods, in particular fabric based blankets and cushions. More specifically, the invention discloses a furniture cushion that can be converted into a blanket.

Description of the Related Art

Furniture, such as couches, armchairs, and the like, are often covered with upholstery fabric. Such furniture is often used in conjunction with various accessories such as color or design coordinated throw pillows, decorative pillows, accent pillows, and the like. In addition to providing additional comfort for the users, such accessory pillows are often used to help coordinate overall room color and design to achieve a pleasing decorative effect.

Such types of furniture is often used in living rooms, family rooms and the like, typically at all times of day and night, including times of the day or night when the room temperature may be cooler than is normally comfortable to the user. In such circumstances, use of blankets, shawls, lap blankets and the like can help keep the user warm, but it can be inconvenient to leave the room and search for such blankets. Further, such blankets may lack proper color and design coordination with the rest of the room.

Various other workers have taught convertible soft good devices that can be converted from one function to the other.

In US design patent D620,739, Mangano taught a specific type of self-storing combination blanket and neck roll assembly. In US design patent D529,745, Eskandry taught a specific type of combination pillow, seat cushion, and blanket design. In U.S. Pat. No. 6,275,993, McCarley taught a moisture repellant cushion, such as a vehicle cushion, that could convert back and forth into a moisture resistant poncho. In US patent application 2004/0199998, Shinner taught a convertible blanket that could be converted into a stuffed animal.

Nonetheless, further advances in the art of convertible soft good devices would be useful.

BRIEF SUMMARY OF THE INVENTION

In one embodiment, the invention may be a convertible pillow and blanket device. This device may have a pillow portion with an interior, an exterior, stuffing, and at least one zipper. The exterior of the pillow portion of the device may comprise a durable fabric such as an upholstery fabric, and often will be configured to the approximate dimensions of an upholstery cushion.

The device will also comprise a blanket portion, where an edge of the blanket portion is connected (via a connected edge) to an interior edge of the pillow portion, typically on an interior side of the pillow portion that is opposite to the zipper side of the pillow portion. The blanket portion, and the interior of the pillow portion of the device, will preferably be fabricated from a material suitable for blankets, such as a plush fabric, and when stowed inside the pillow portion, the blanket portion can serve as stuffing for the pillow portion.

The device's blanket portion and the pillow portion will be typically constructed according to dimensions that have selected to enable, in a first configuration, the blanket portion to be folded entirely inside the interior of the pillow portion. In this configuration, when the at least one zipper is shut, the blanket portion will be entirely inside the pillow portion, leaving only the upholstery fabric on the exterior of the pillow portion (and perhaps portions of the zipper) showing.

The device's blanket portion and pillow portion will also have dimensions selected to enable, in a second configuration, the pillow portion to be inverted. Essentially the pillow can be turned inside out, exposing the interior of the pillow portion to the outside, and also enabling the blanket portion to be unfolded outside the pillow portion. The net result will be to produce a blanket, with the now empty and collapsed pillow portion remaining attached to the blanket portion by their common connected edge. When use of the blanket portion is no longer desired, the process may be reversed, and the device converted back to its nominal pillow configuration.

Thus some of the advantages of the present invention (device) are that it provides a way to conveniently package and store blankets in the close proximity of furniture such as couches, which are often placed in living rooms, family rooms, media rooms, and the like, where one or more users may unexpectedly want extra warmth. As desired, multiple units of the present device may be provided, for example for couches that can seat multiple users. By providing multiple units of the present device, so multiple blankets can also be provided in a neat, space efficient and convenient manner.

By contrast, consider what would happen if conventional blankets were used instead. If conventional blankets were used, these blankets would become tangled or messy. If conventional blankets were used, after use, these blankets would have to be stored in separate storage containers or closets. This would take up extra room, and impose a burden on the user(s) to find and retrieve the blankets again for later use. By using the present invention, these problems can be avoided.

Thus, particularly when used in conjunction with commonly used furniture such as couches, and common settings such as living rooms or media rooms, the present invention provides a convenient system of providing quick access to one or more blankets, each stored in an attractive and efficient manner.

3K shows another view ("underside") of an alternative embodiment of the device now fully unfolded in its second (blanket) configuration, showing the location of at least one optional mechanical fastener.

Figures 3A, 3B, 3C, 3D:
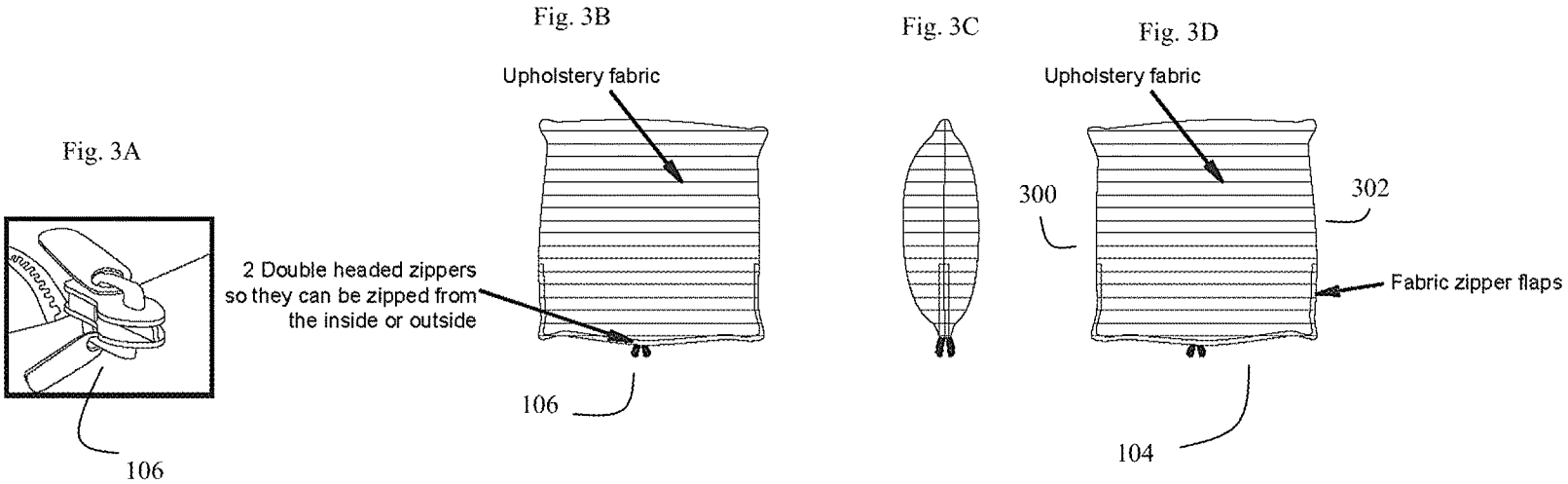
FIG. 3A shows a detail of a zipper head that may be used in the device.
FIG. 3B shows that in a preferred embodiment, the exterior of the first pillow configuration of the device may be formed from upholstery fabric.
FIG. 3C shows another side view of the pillow form of the device.
FIG. 3D shows that in some embodiments, the device may employ at least two zipper heads, with the zipper flaps extending at least partially along adjacent sides of the pillow.
Figures 3E, 3F, 3G, 3H, 3I, 3J:
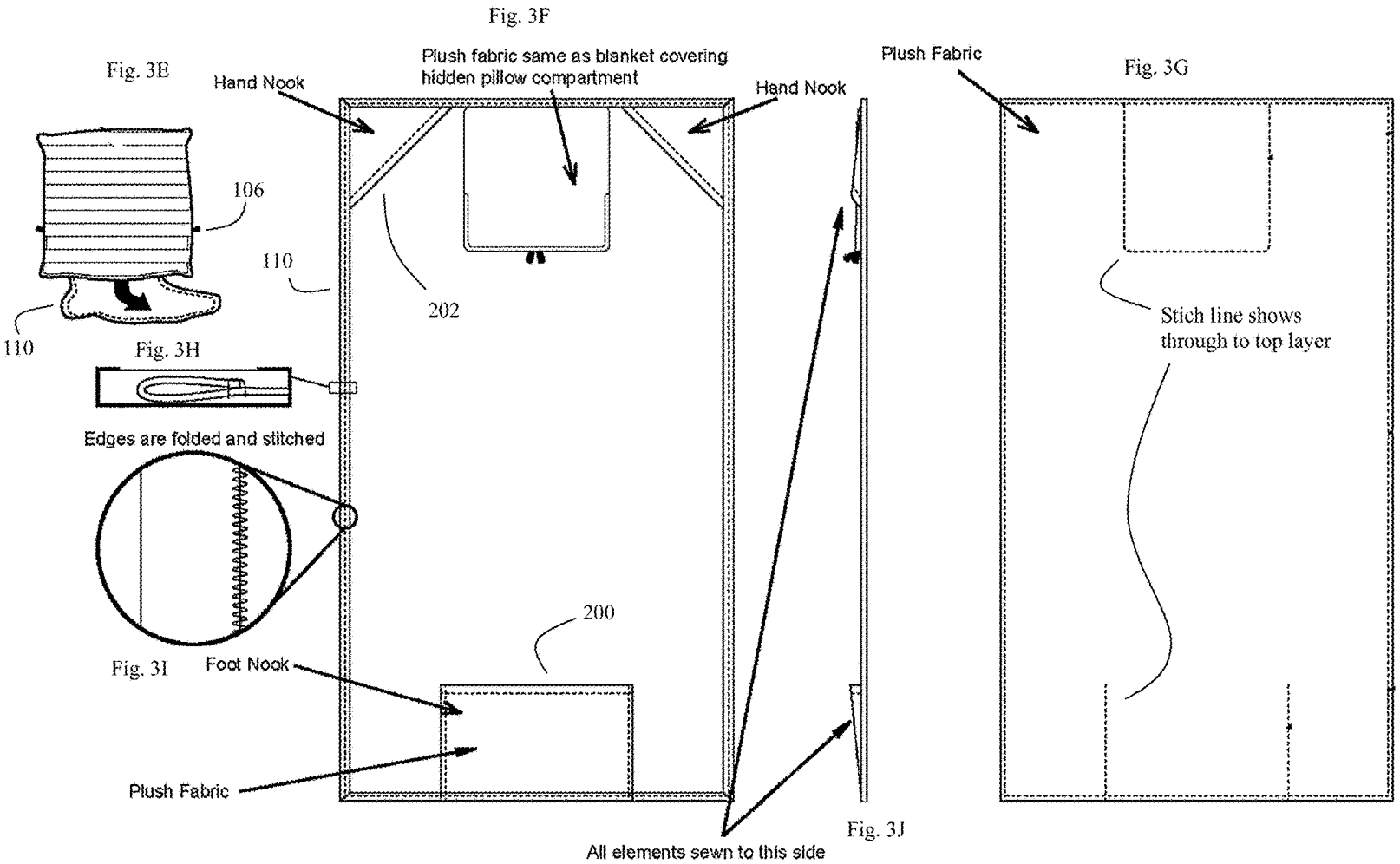
FIG. 3E shows another view of the front of the pillow device with the zippers open, and with parts of the blanket portion of the device, previously stored interior to the pillow portion, now exposed.
FIG. 3F shows another view ("underside") of the device now fully unfolded in its second (blanket) configuration.
FIG. 3G shows a view of the opposite major side ("top side") of the blanket form of the device.
FIG. 3H shows a detail of an edge of the blanket form of the device.
FIG. 3I shows a detail of a type of zig-zag stitching pattern that may be used to form one or more edges of the blanket form of the device.
FIG. 3J shows a side view of the blanket form of the device, showing that the collapsed sides and zippers of the pillow form of the device, as well as the optional foot pouch (foot nook) and optional hand pouches (hand nooks) of the device are all exposed on the underside of the pillow form of the device.
Figures 3K, 3L, 3M:
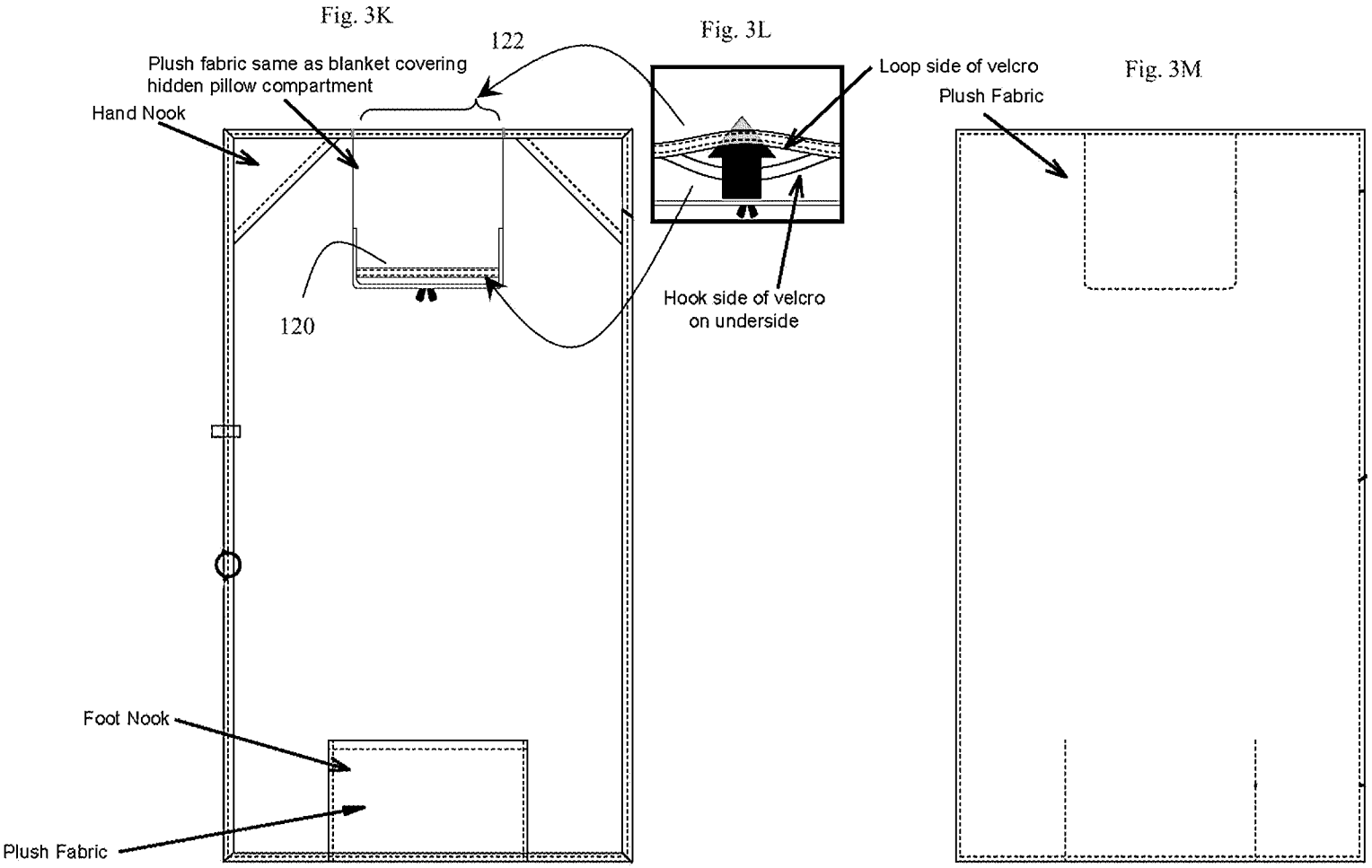

FIG. 3L shows a detail of at least one optional seam or mechanical fastener (here a hook and loop type mechanical fastener) which may be disposed on one or more locations in the device to facilitate embroidery of the pillow form of the device.

FIG. 3M shows a view of the opposite major side ("top side") of an alternative embodiment of the blanket form of the device.

FIGS. 4A-4H show one process for converting the device from its second "blanket" configuration to the device's first "pillow" configuration.

FIGS. 5A-5D and 5H-5I shows an alternative process for converting the device from its second "blanket" configuration to the device's first "pillow" configuration.

FIGS. 6A-6D show how the device may be used as a blanket when the device is in the second "blanket" configuration.

Figure 7:
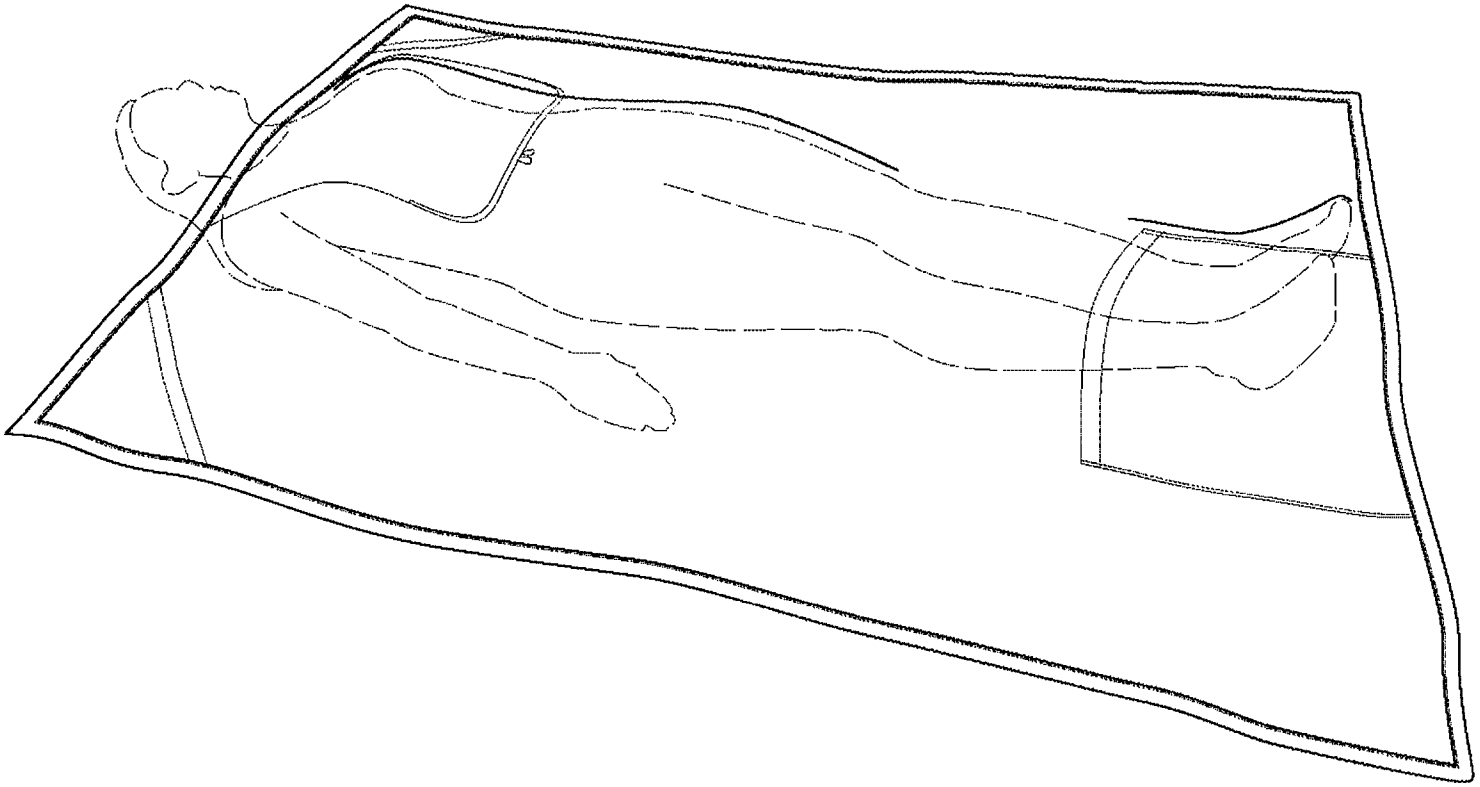

FIG. 7 shows a human user using the blanket form of the device while lying down.

Figure 8:
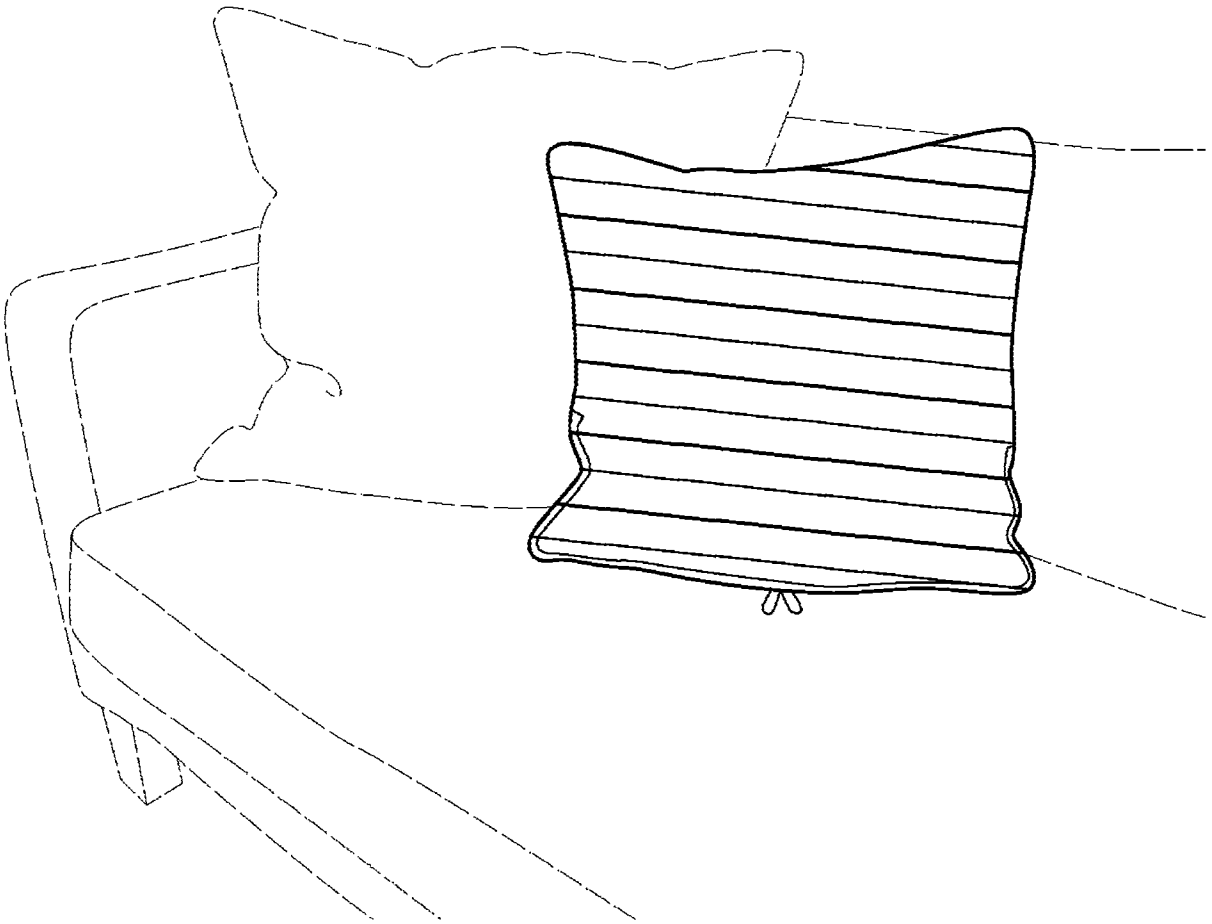
Figure 9A:
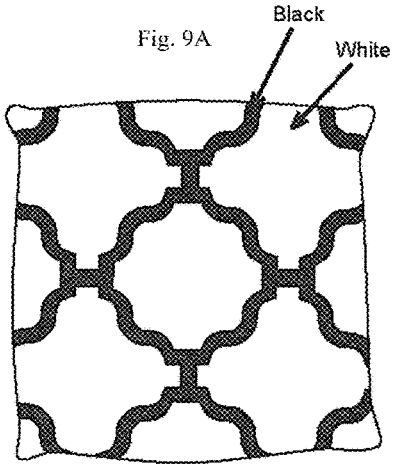
Figure 9B:
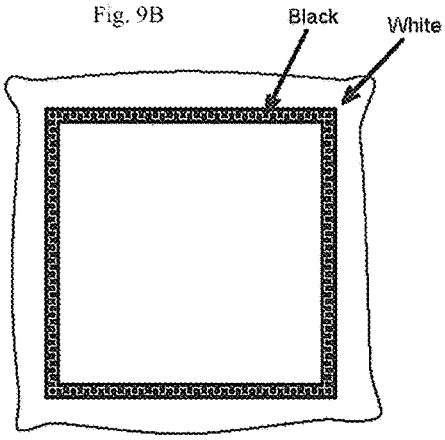
Figure 9C:
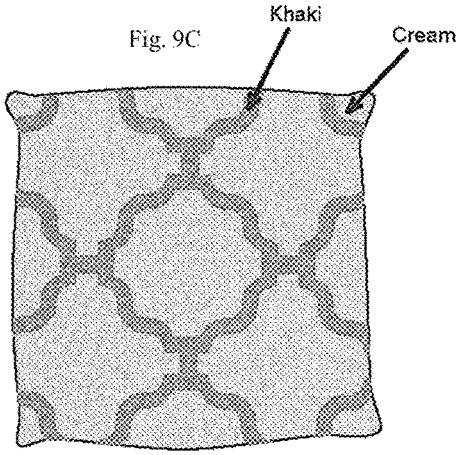
Figure 9D:
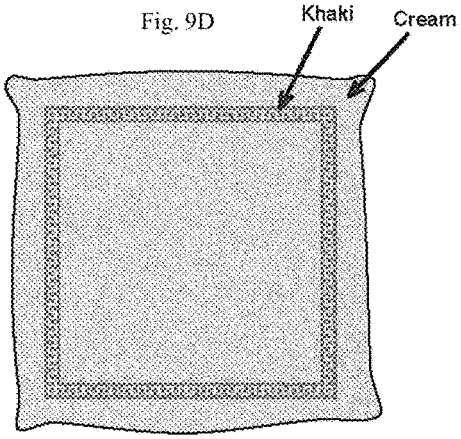
Figure 9E:
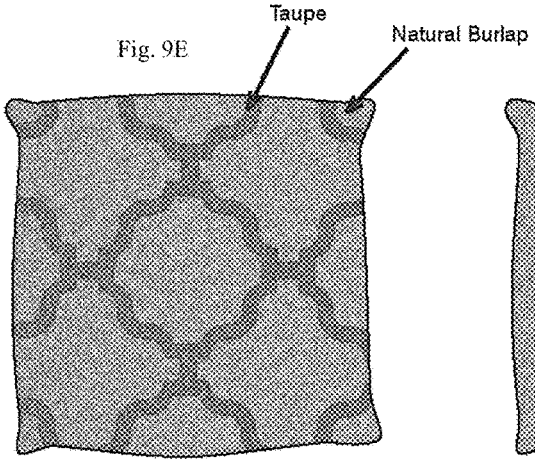
Figure 9F:
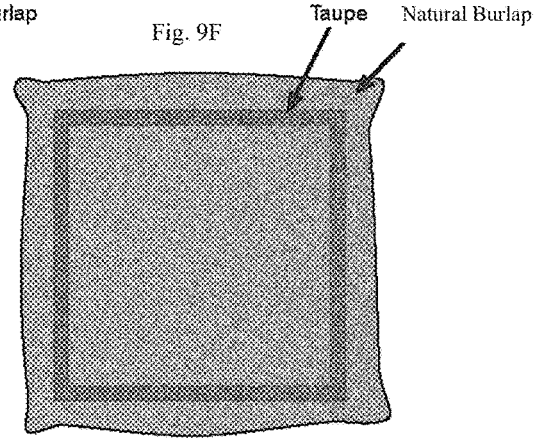
Figure 9G:
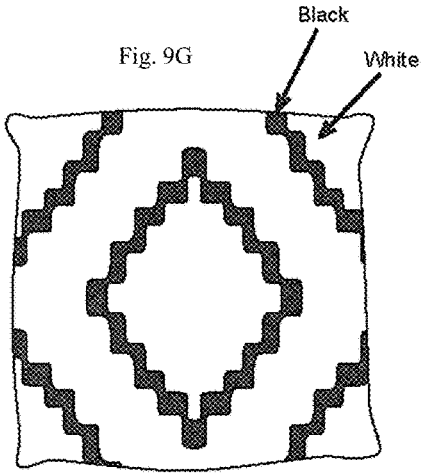
Figure 9H:
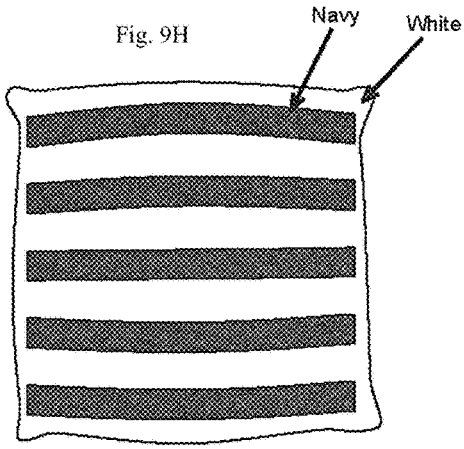
Figure 9I:
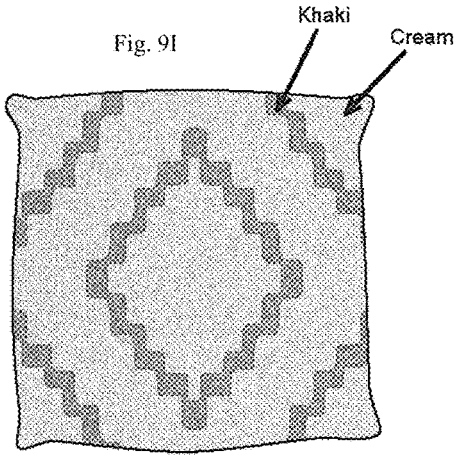
Figure 9J:
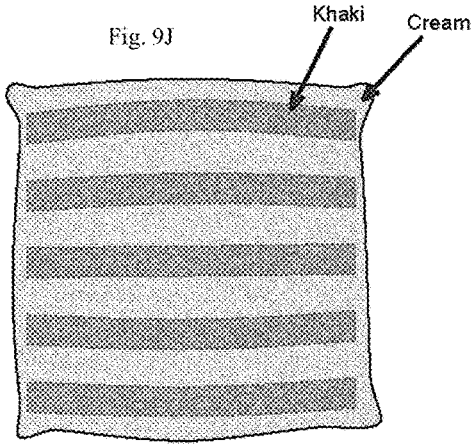
Figure 9K:
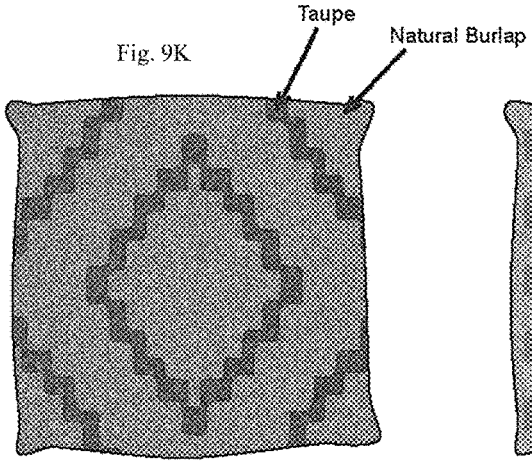
Figure 9L:
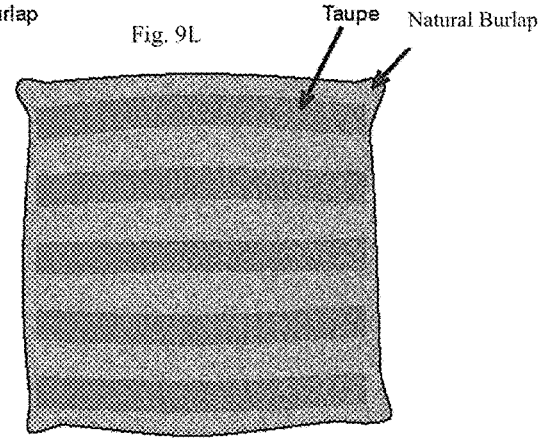
Figure 10A:
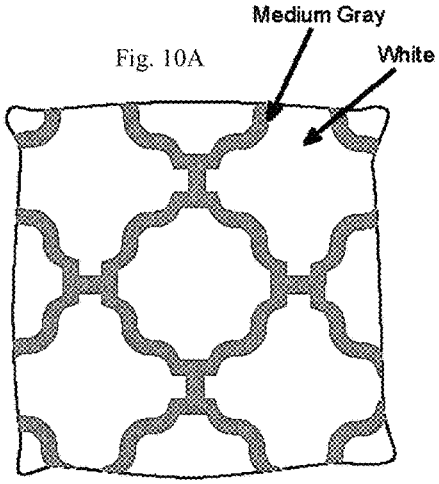
Figure 10B:
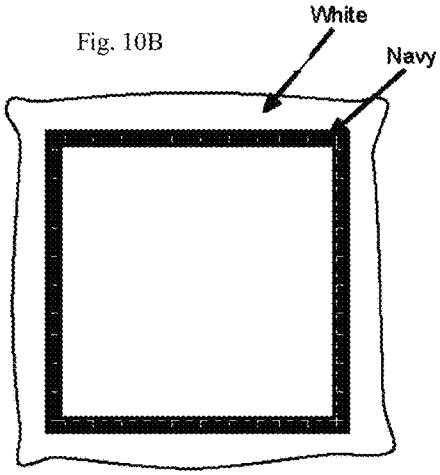
Figure 10C:
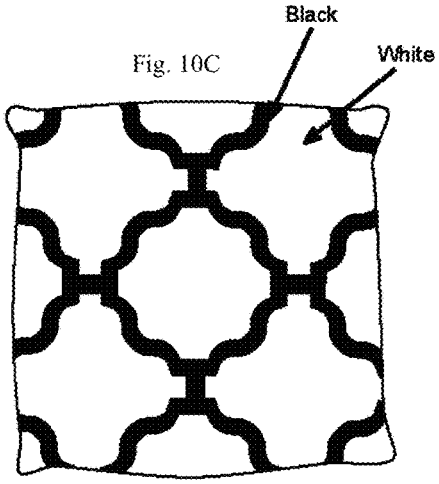
Figure 10D:
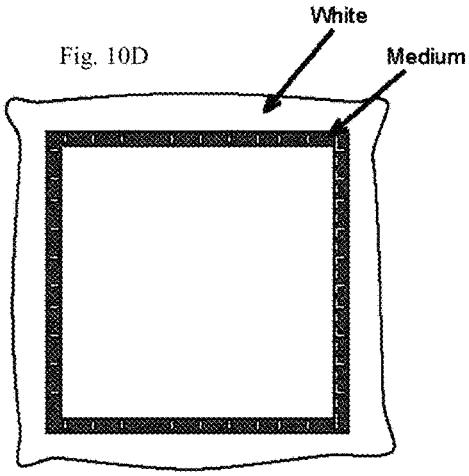
Figure 10E:
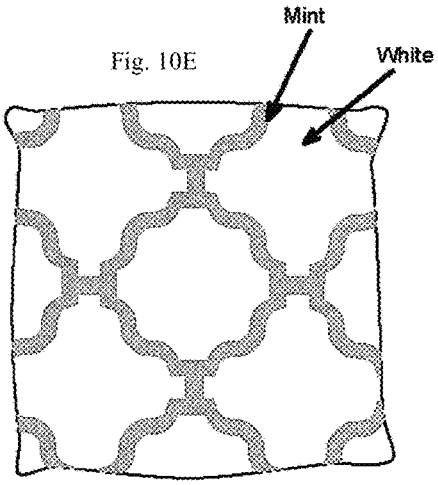
Figure 10F:
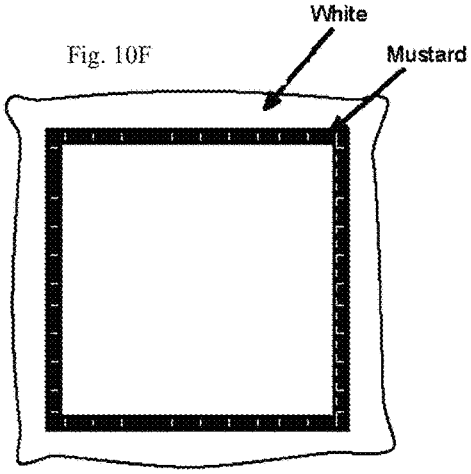
Figure 10G:
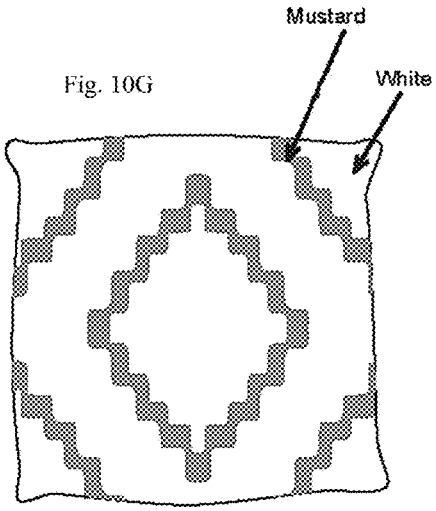
Figure 10H:
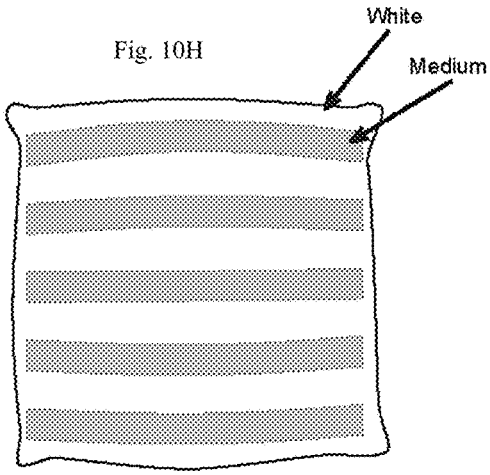
Figure 10I:
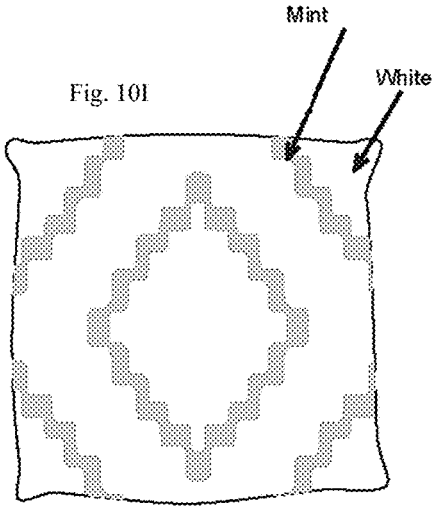
Figure 10J:
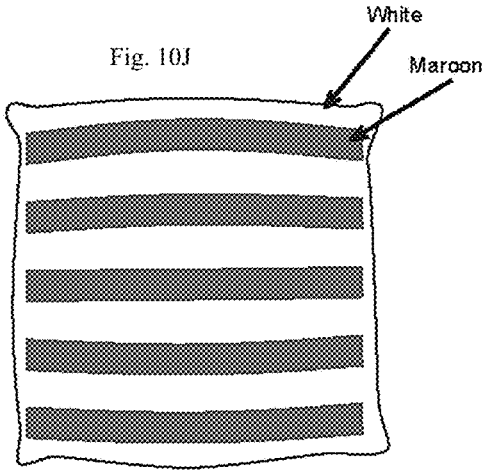
Figure 10K:
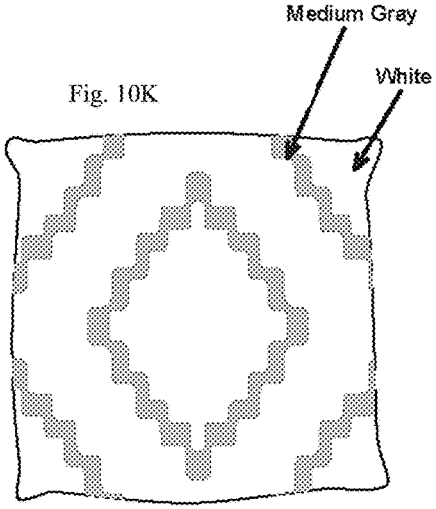
Figure 10L:
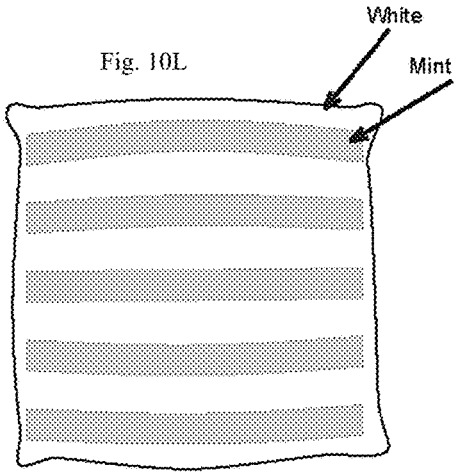
Figure 11A:
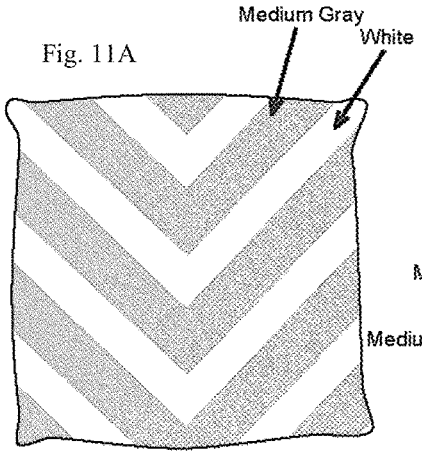
Figure 11B:
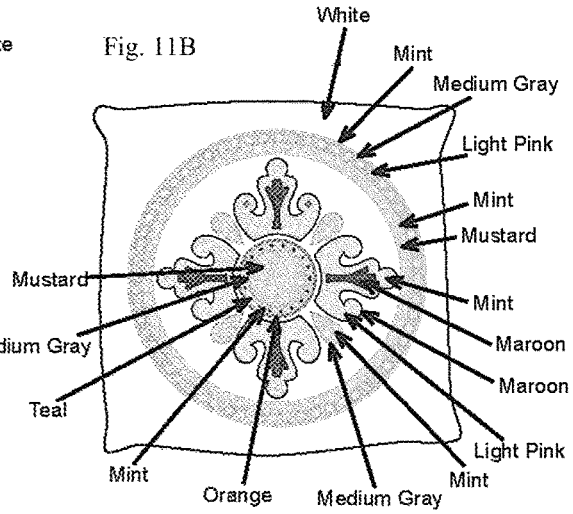
Figure 11C:
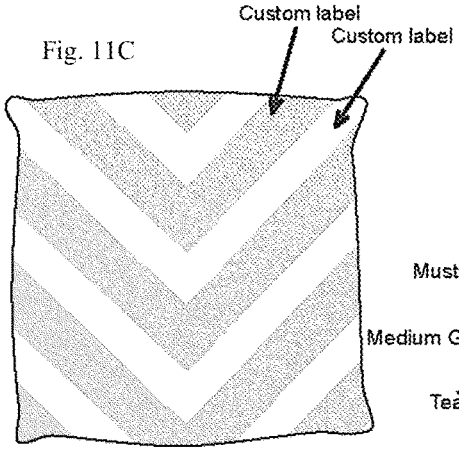
Figure 11D:
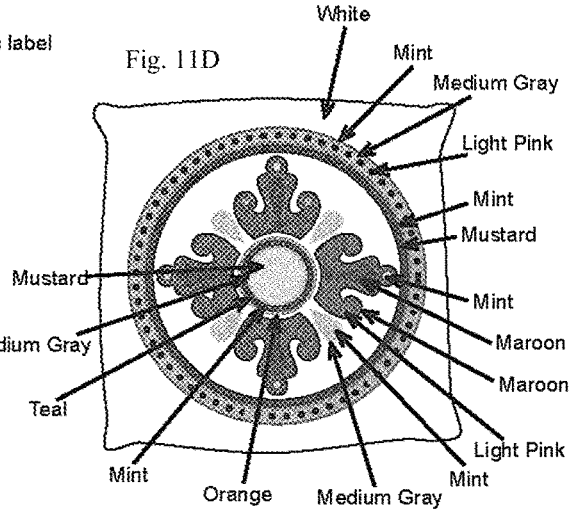
Figure 11E:
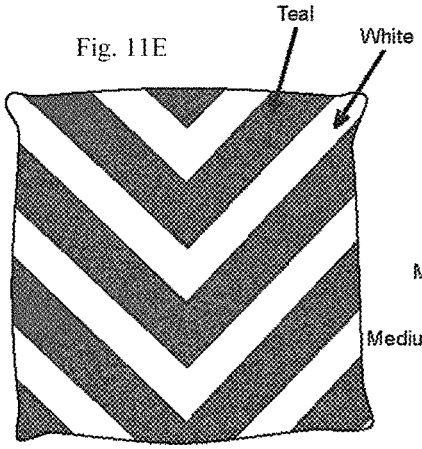
Figure 11F:
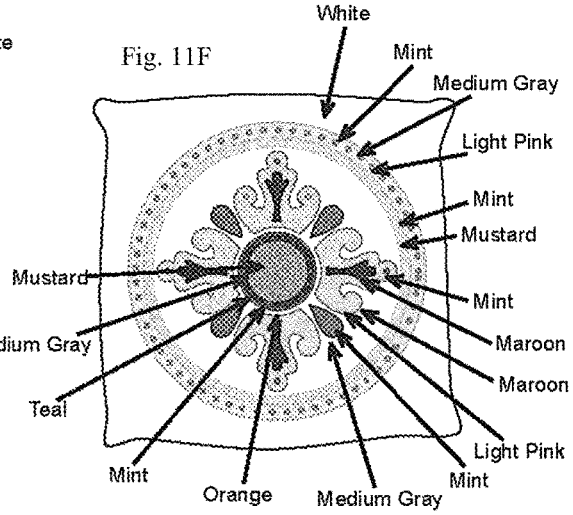
Figure 11G:
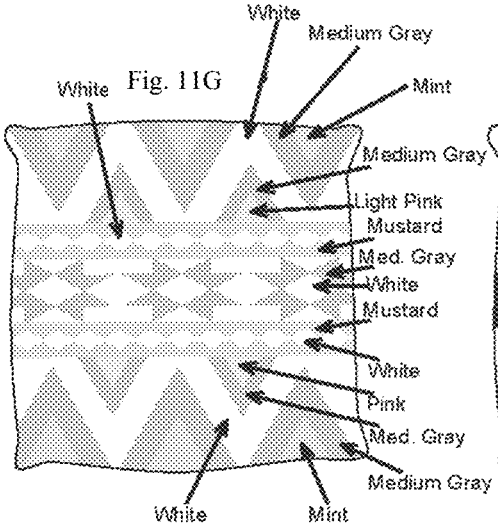
Figure 11H:
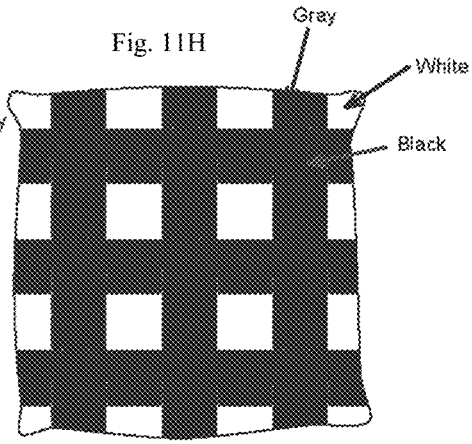
Figure 11I:
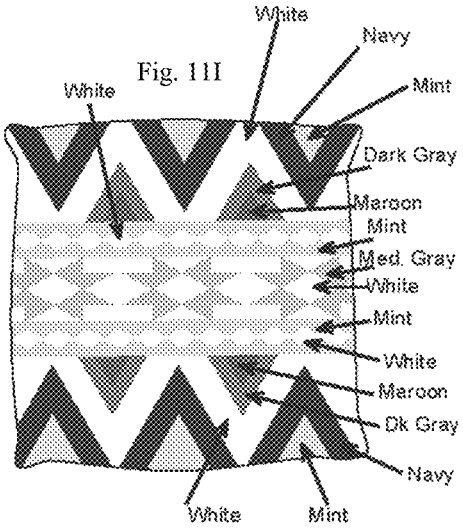
Figure 11J:
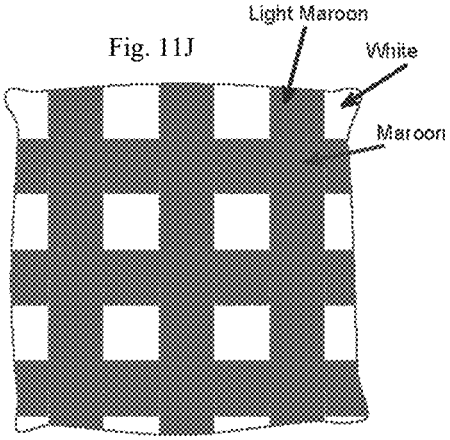
Figure 11K:
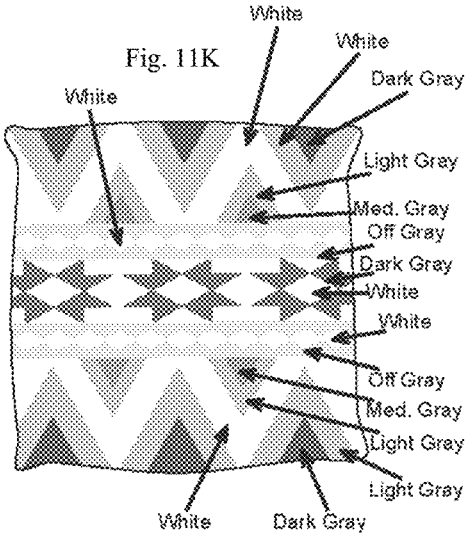
Figure 11L:
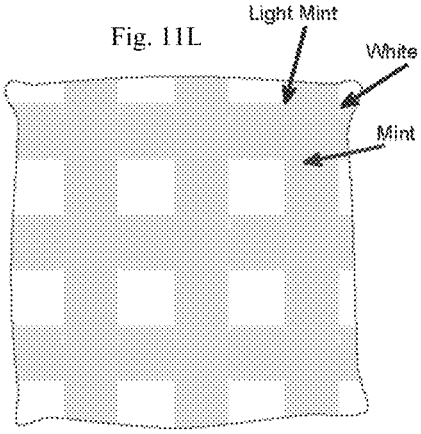
Figure 12A:
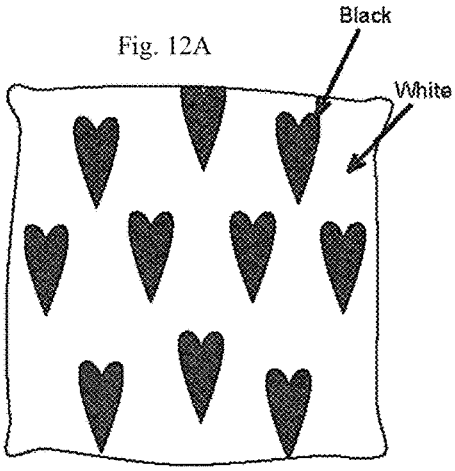
Figure 12B:
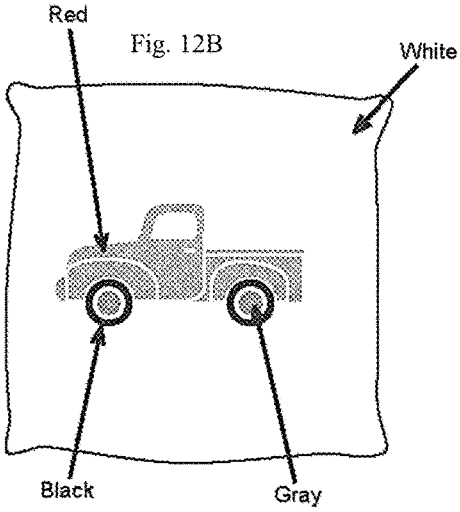
Figure 12C:
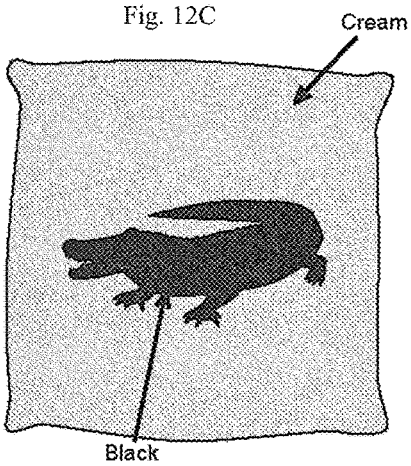
Figure 12D:
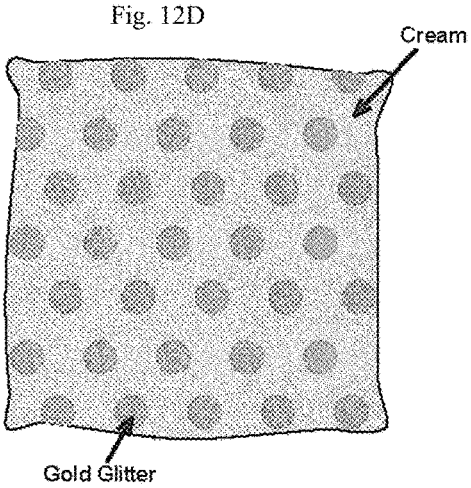
Figure 12E:
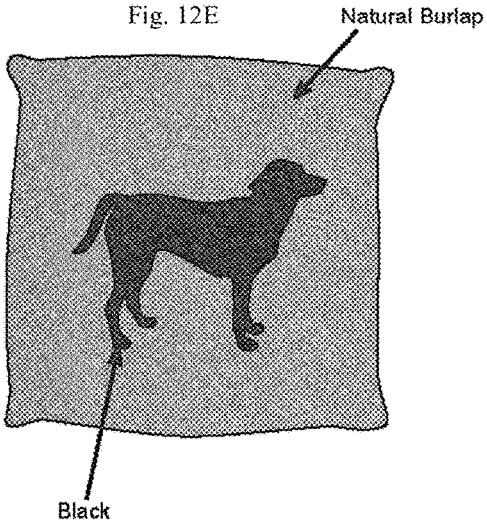
Figure 12F:
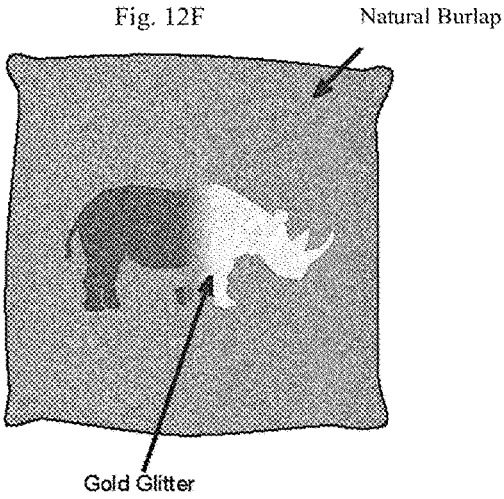
Figure 12G:
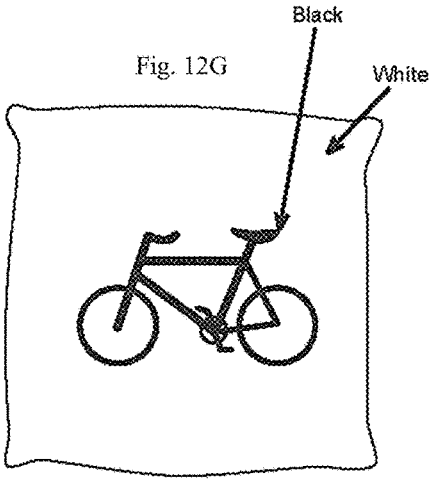
Figure 12H:
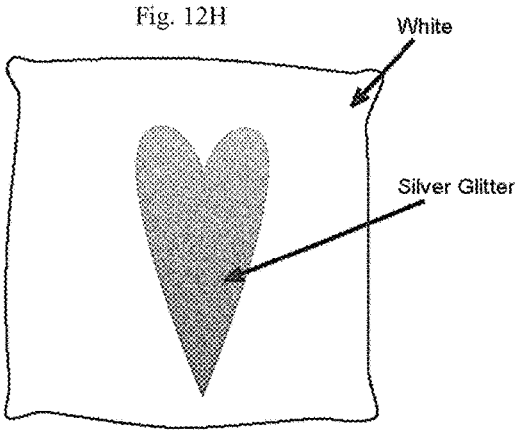
Figure 12I:
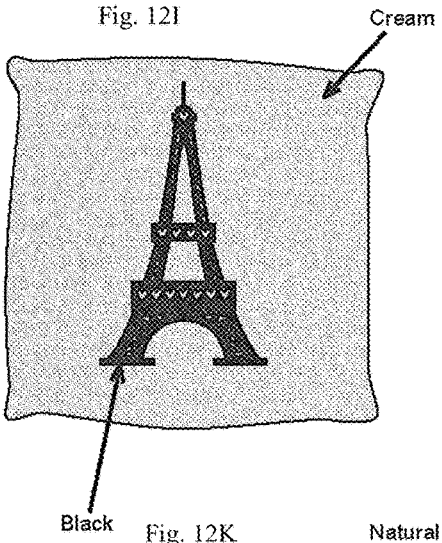
Figure 12J:
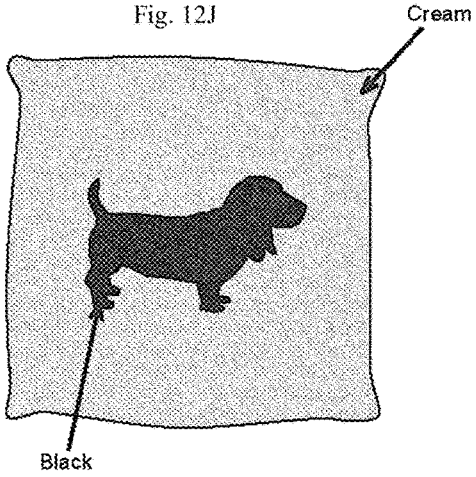
Figure 12K:
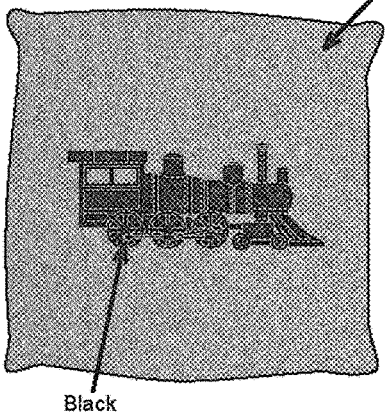
Figure 12L:
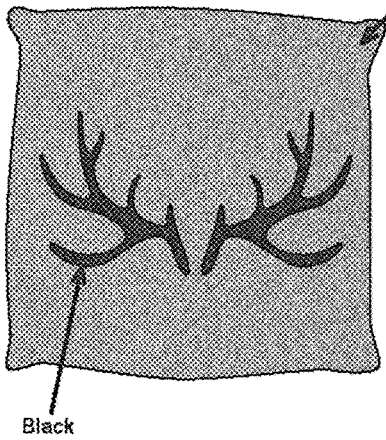
Figure 13A:
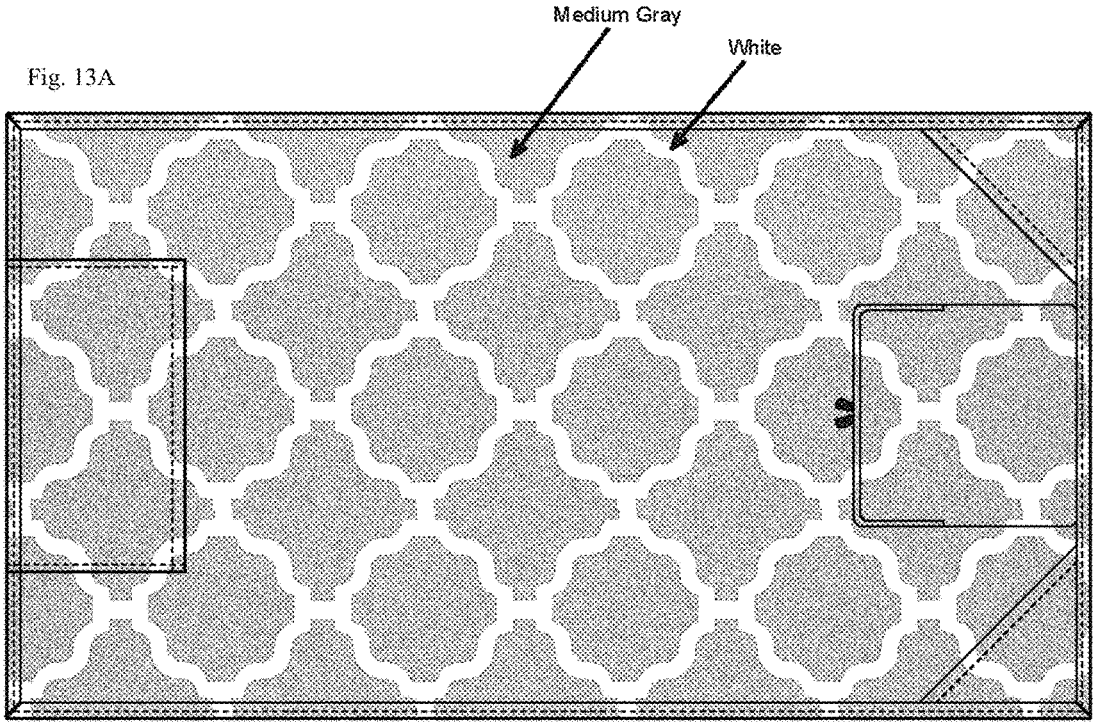
Figure 13B:
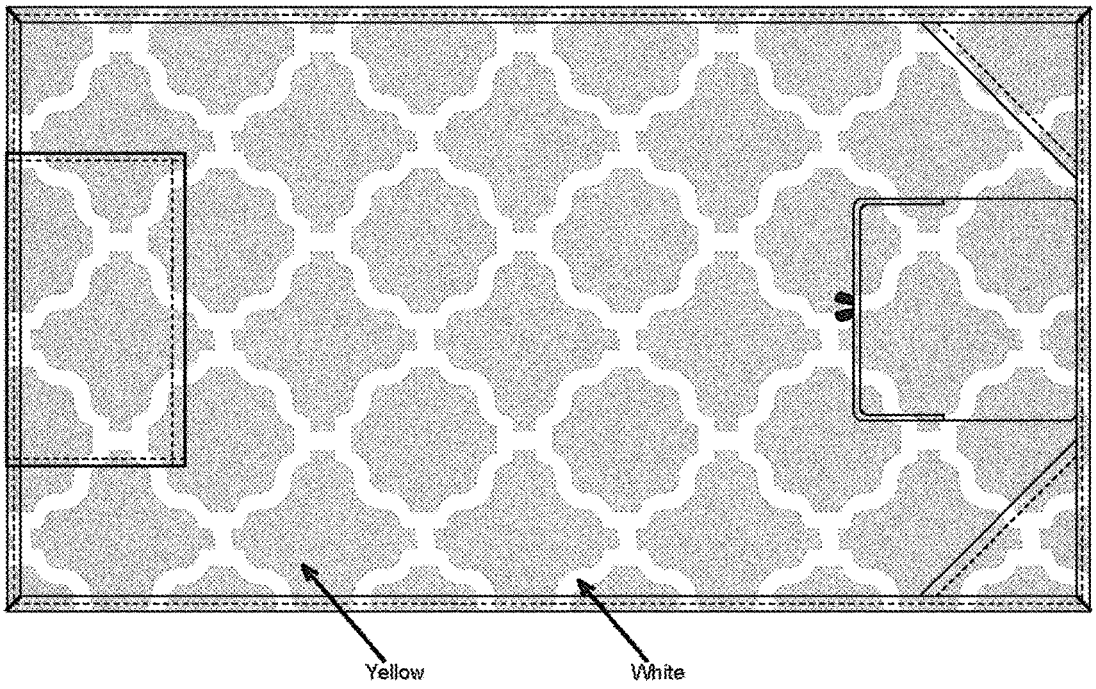
Figure 13C:
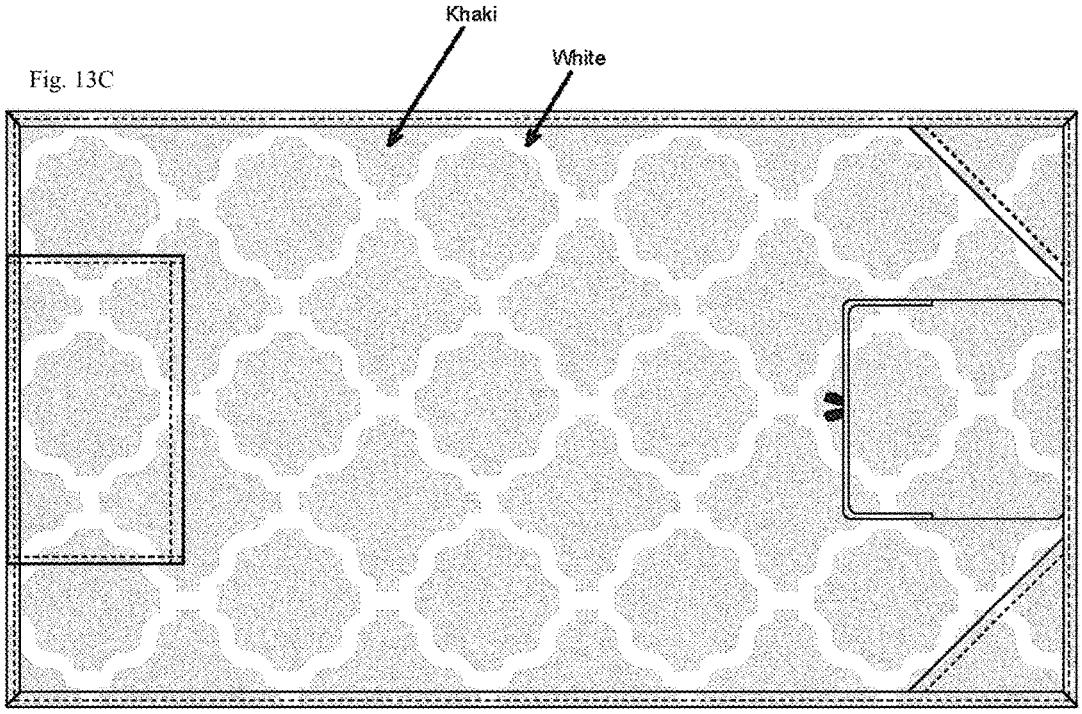
Figure 13D:
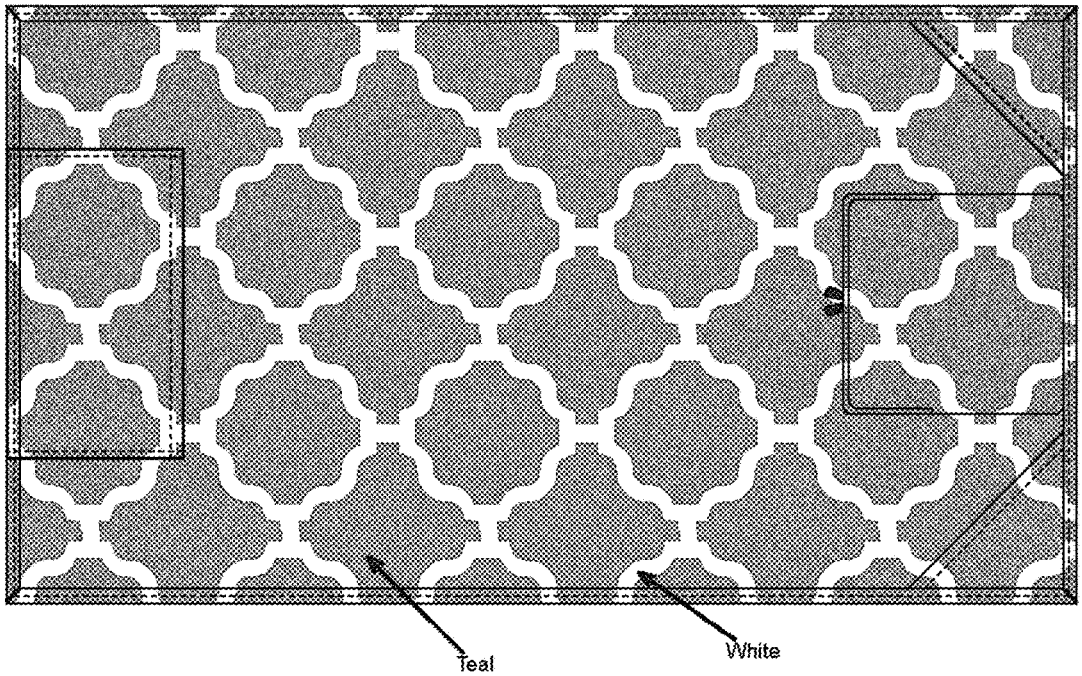
Figure 14A:
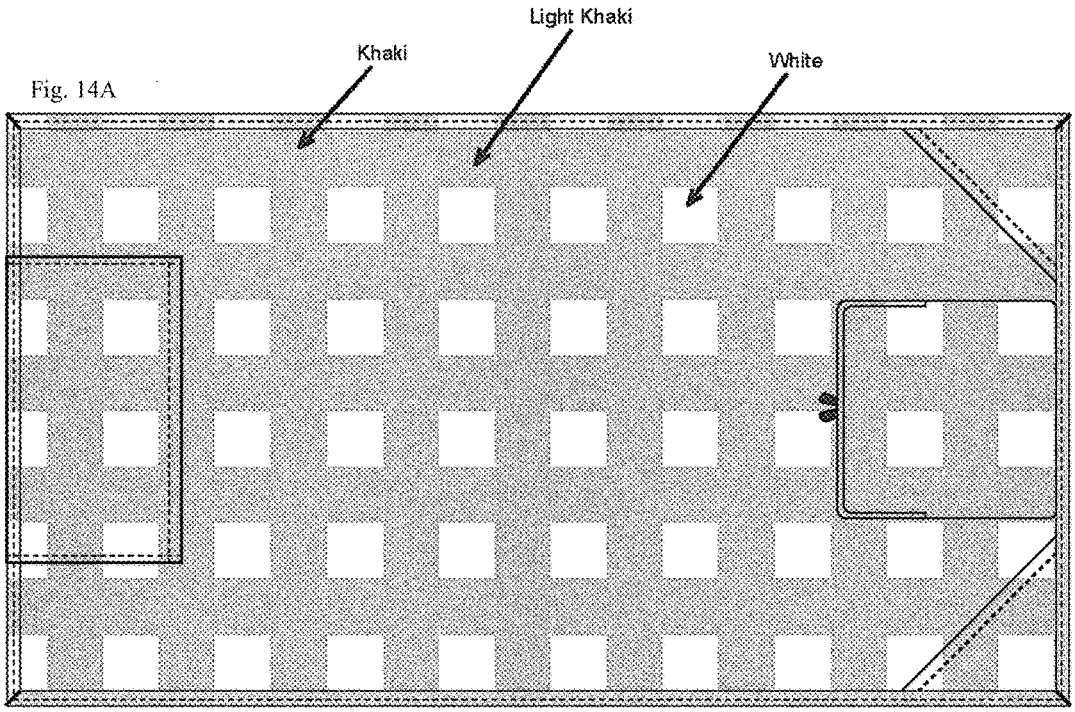
Figure 14B:
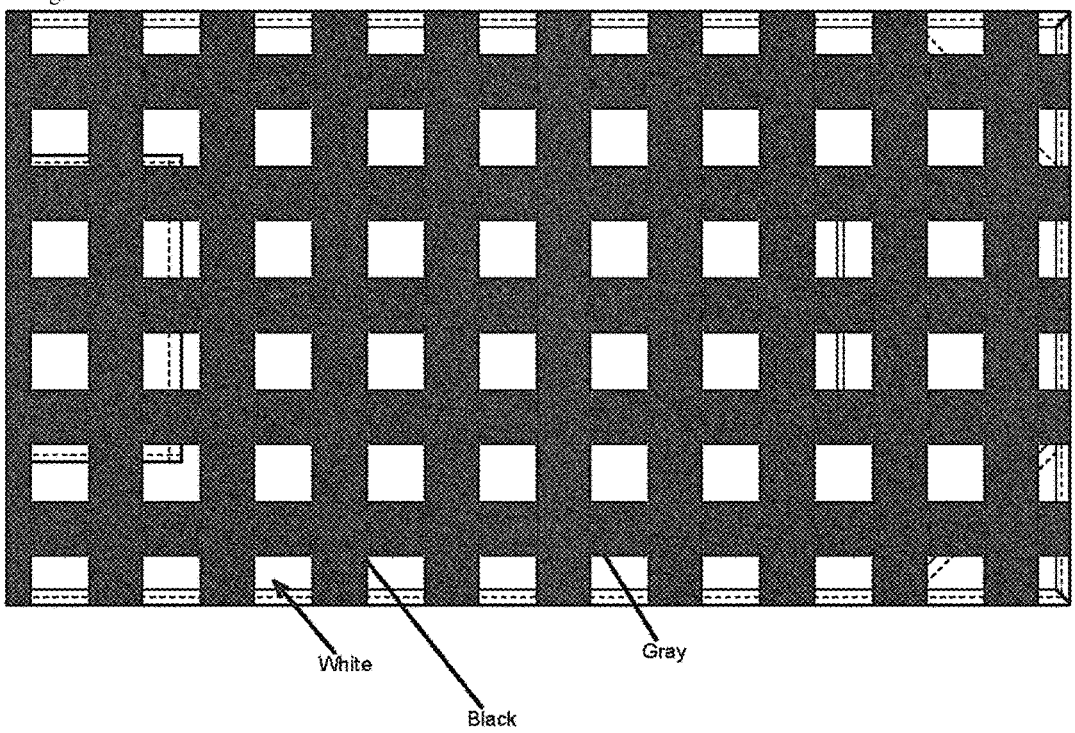
Figure 14C:
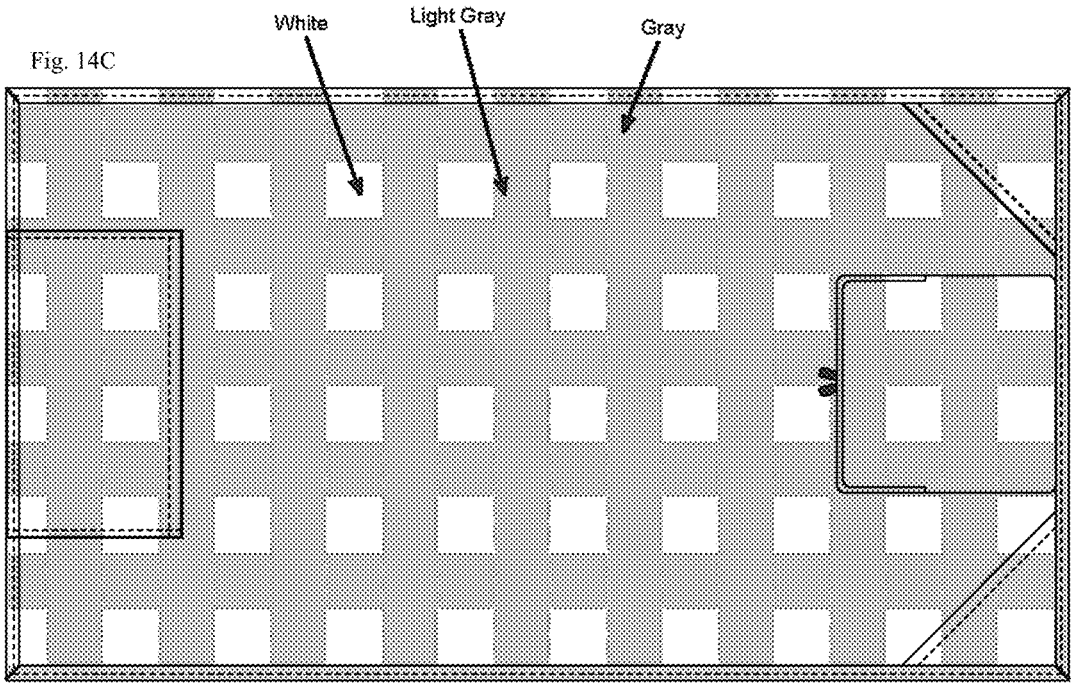
Figure 14D:
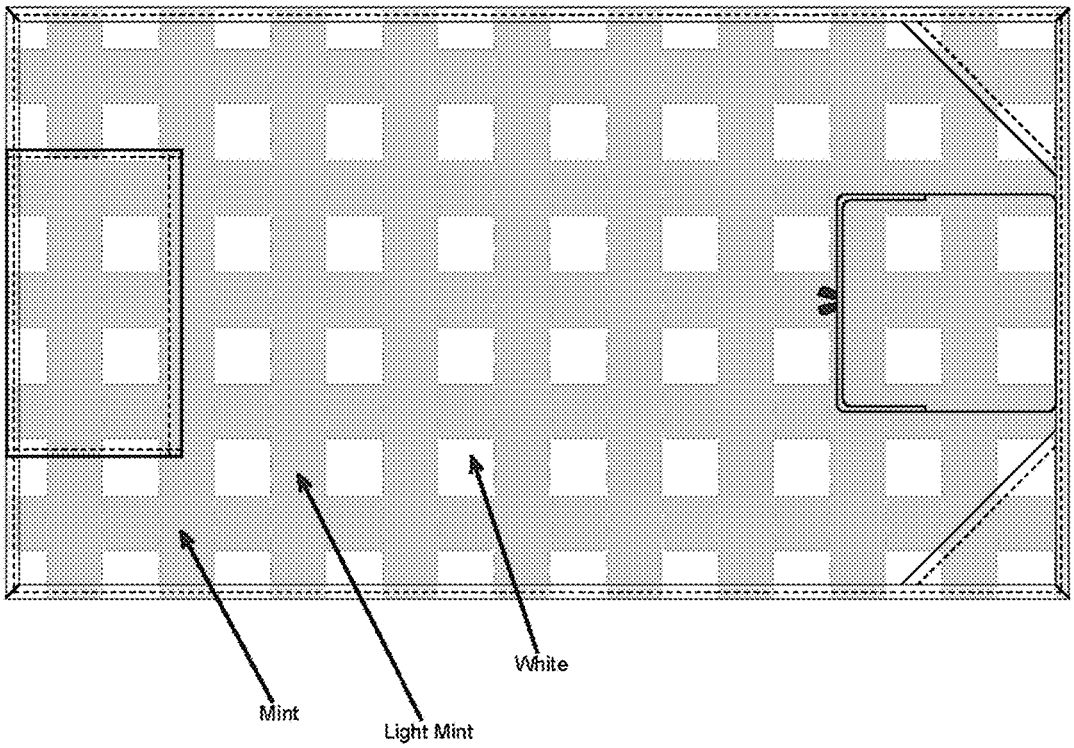
Figure 15A:
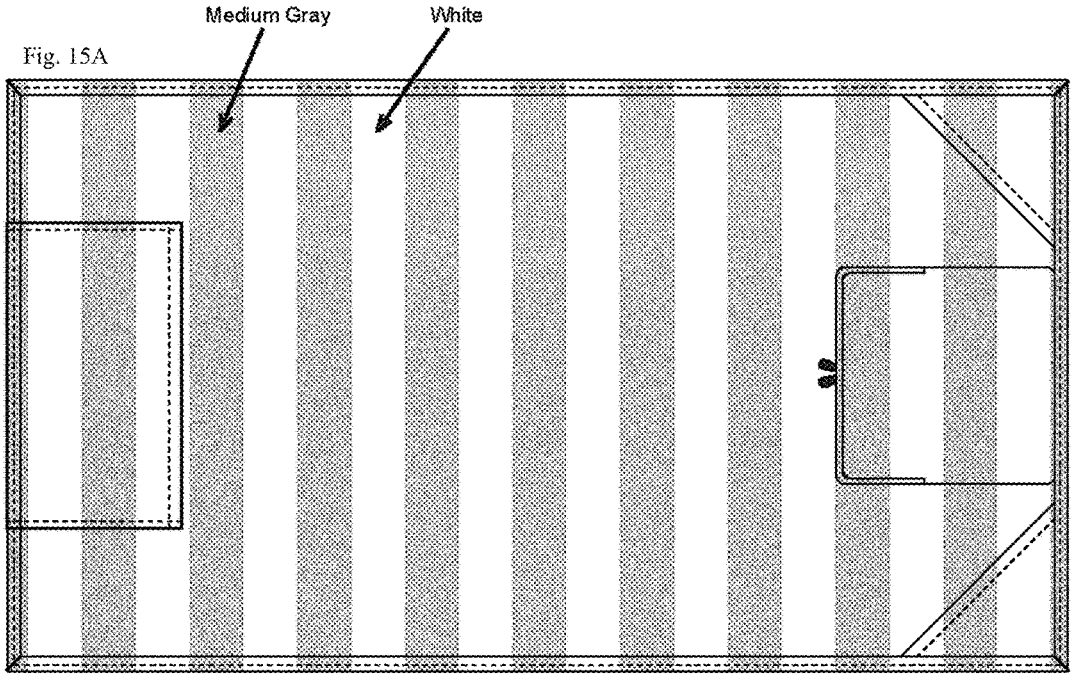
Figure 15B:
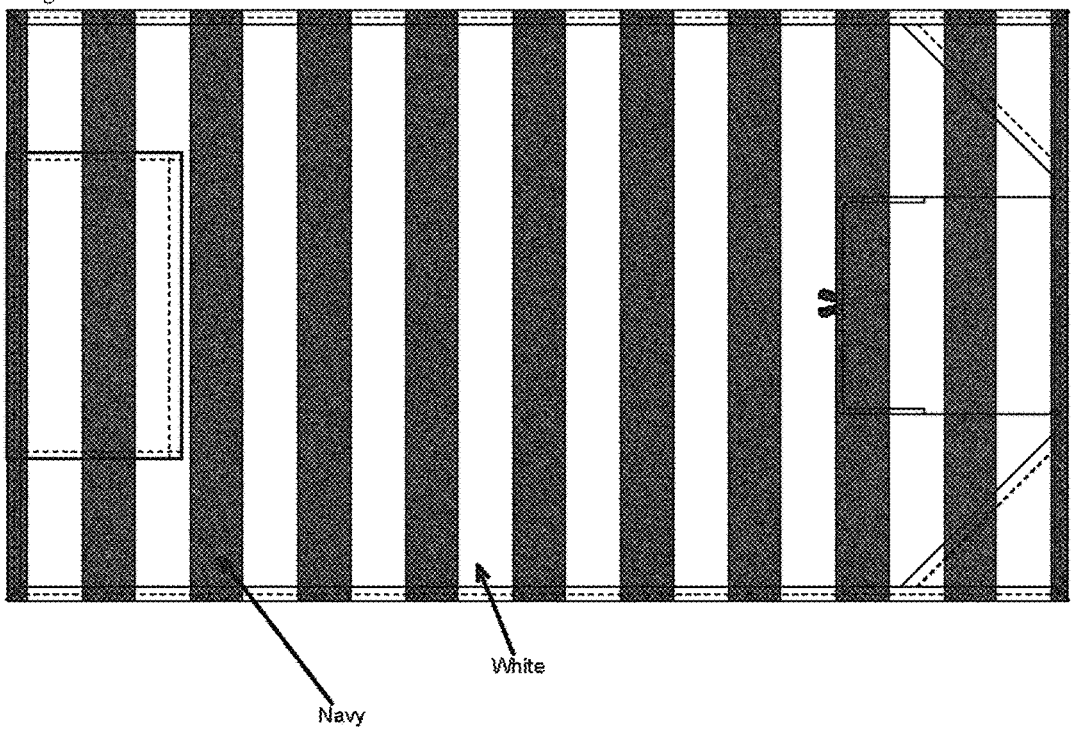
Figure 15C:
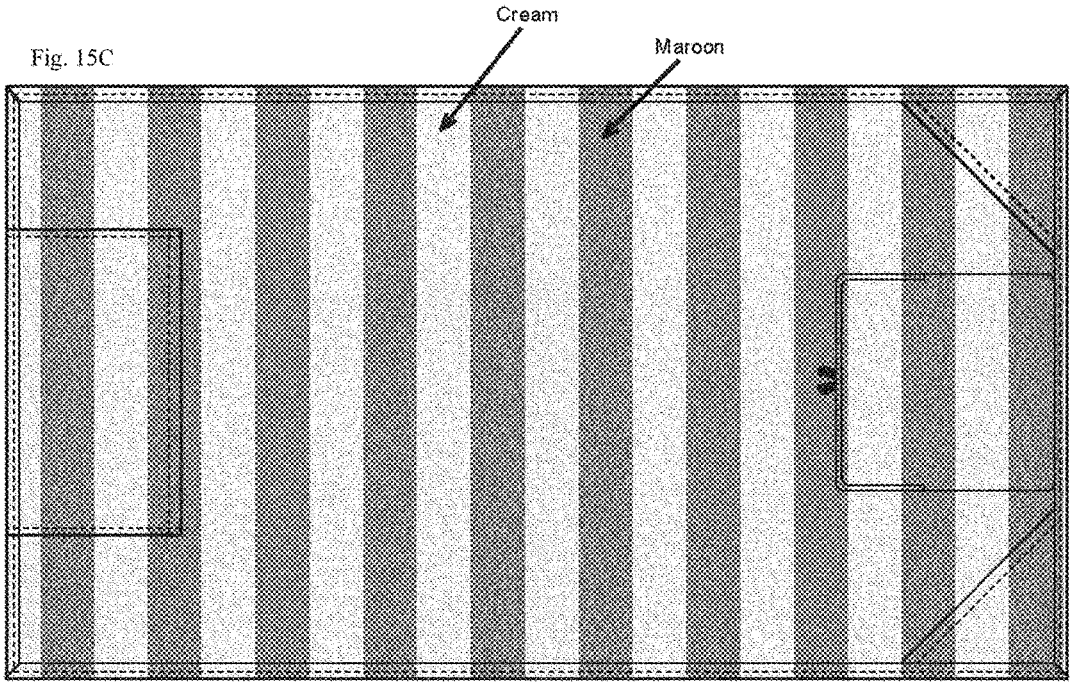
Figure 15D:
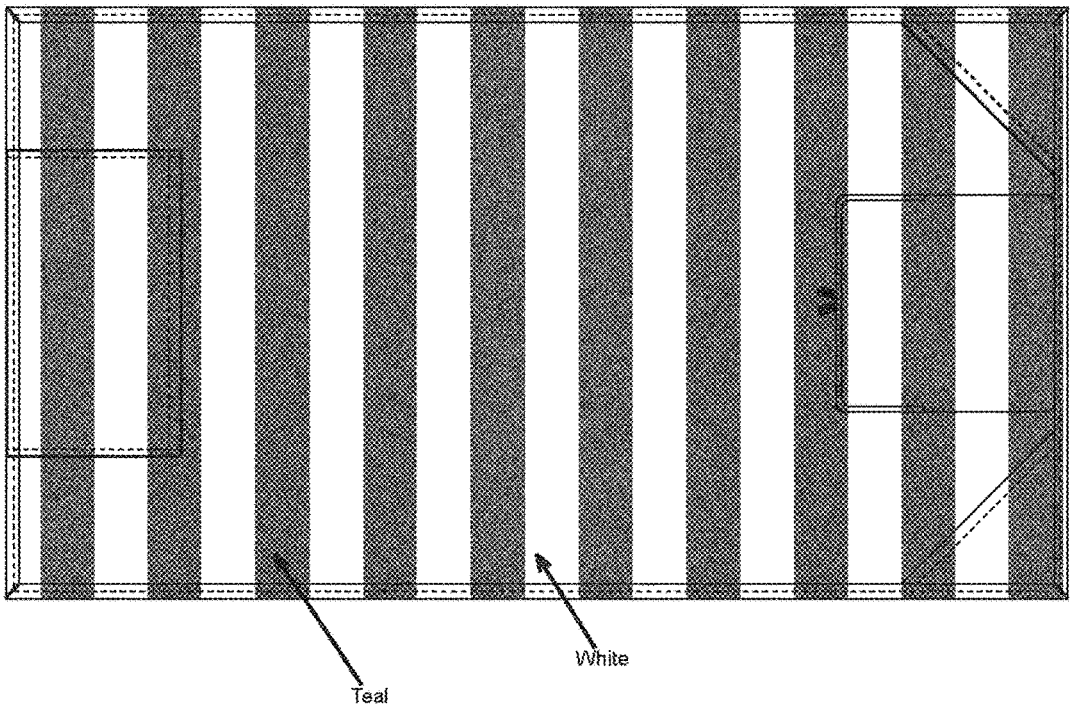
Figure 16A:
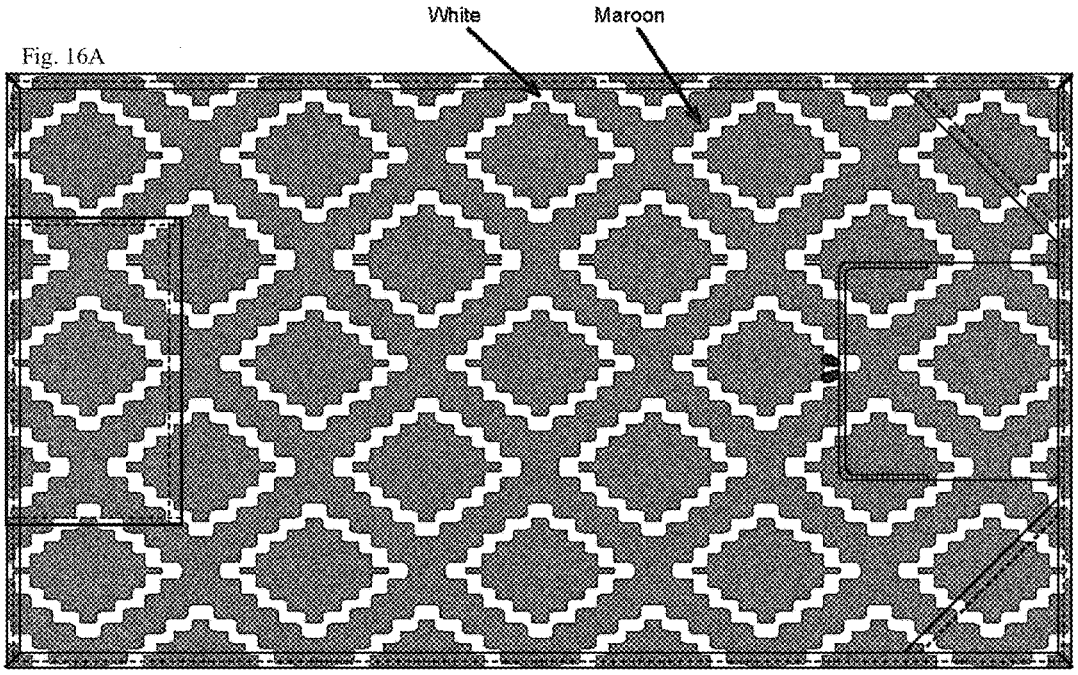
Figure 16B:
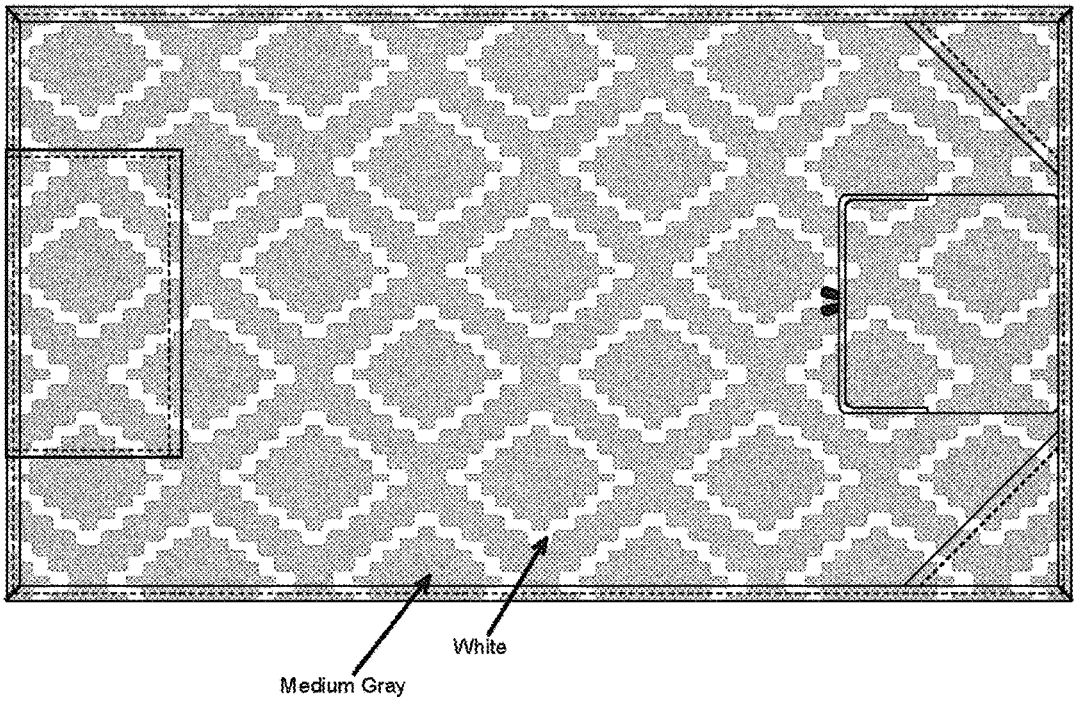
Figure 16C:
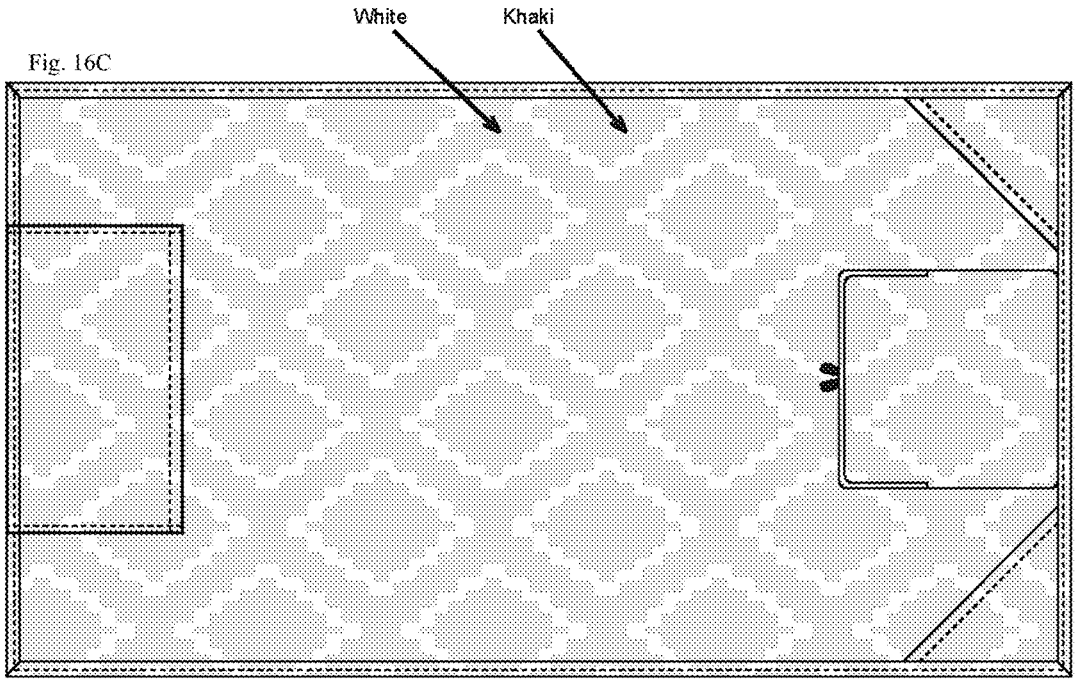
Figure 16D:
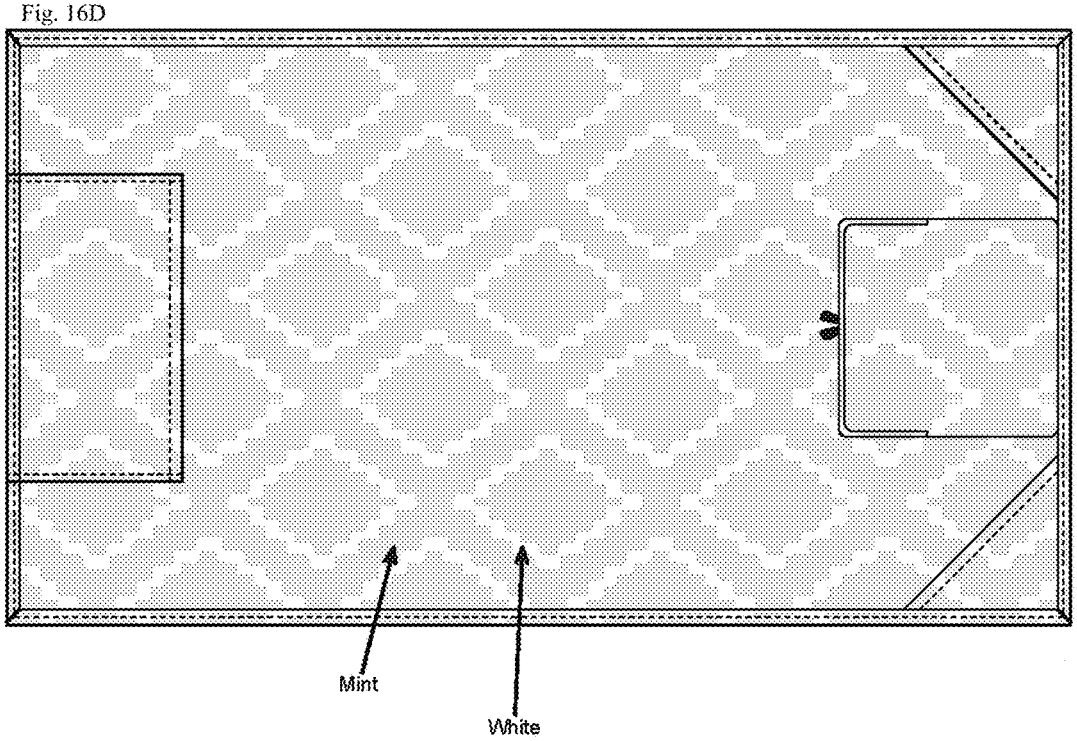

FIG. 8 shows how the device, in the first "pillow" configuration, has a design that is intended to match standard furniture pillows and upholstery.

FIGS. 9A-9L show various decorative designs for the exterior upholstery side of the first "pillow" configuration of the device.

FIGS. 10A-10L show additional decorative designs for the exterior upholstery side of the first "pillow" configuration of the device.

FIGS. 11A-11L show additional decorative designs for the exterior upholstery side of the first "pillow" configuration of the device.

FIGS. 12A-12L show additional decorative designs for the exterior upholstery side of the first "pillow" configuration of the device.

FIGS. 13A-13D show that the second "blanket" configuration of the invention may also be configured with a large number alternative decorative designs and color configurations.

FIGS. 14A-14D show additional decorative blanket designs.

FIGS. 15A-15D show additional decorative blanket designs.

FIGS. 16A-16D show additional decorative blanket designs.

DETAILED DESCRIPTION OF THE INVENTION

Figures 1A, 1B:
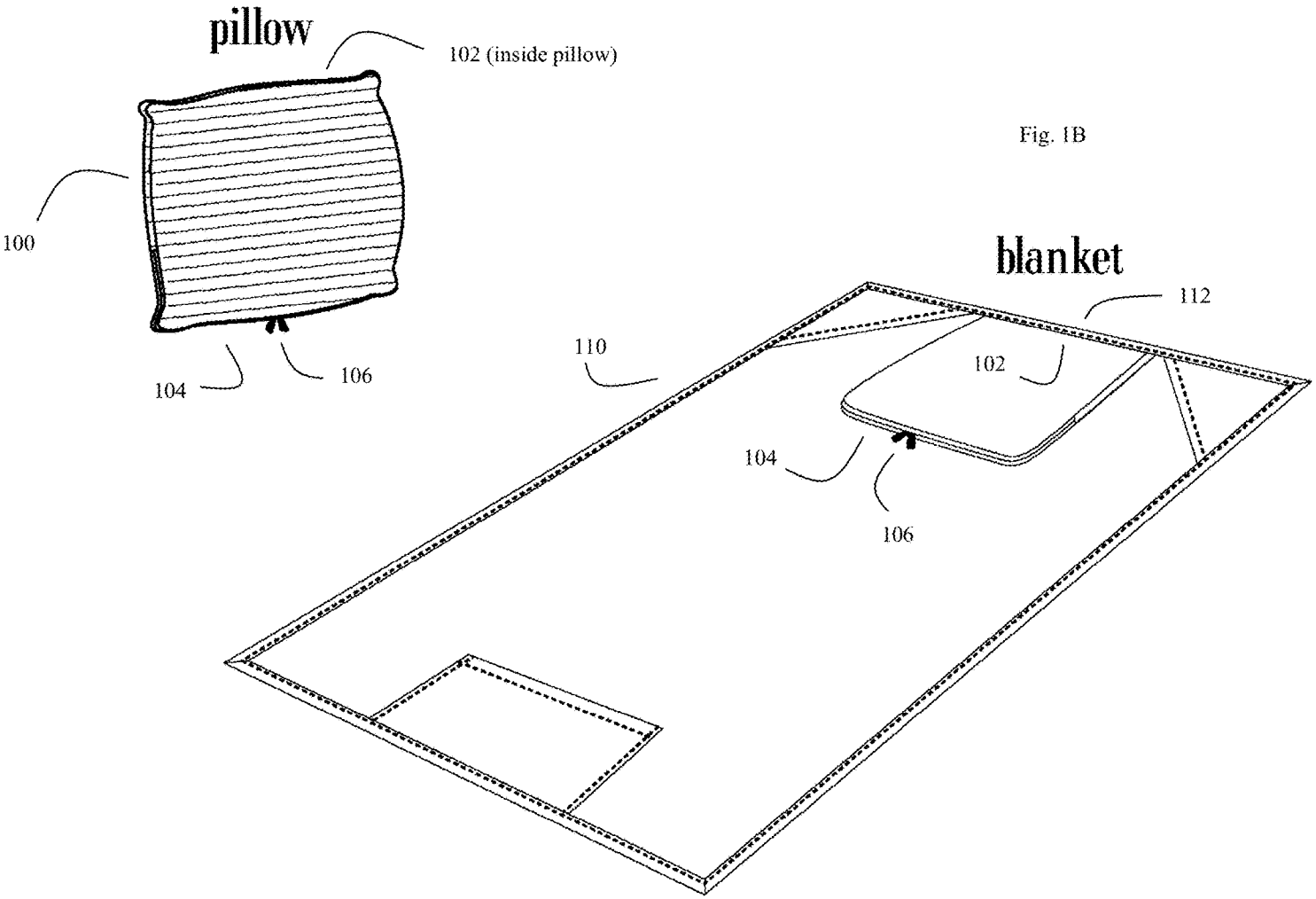
FIG. 1A shows the device in its first (pillow) configuration.
FIG. 1B shows the device in its second (blanket) configuration.

FIG. 1A shows the device in its first (pillow) configuration, and FIG. 1B shows the device in its second (blanket) configuration.

As previously discussed, in some embodiments, the invention may be a convertible pillow and blanket device. In some embodiments, this device may comprise a pillow portion (100) with an interior, an exterior, and at least one zipper with at least one zipper head (106) extending along at least one zipper side (104) of the pillow portion. In a preferred embodiment, the exterior of the pillow portion will comprise upholstery fabric, and will be configured to approximately the dimensions of a standard upholstery or upholstery accessory cushion. This upholstery fabric is shown by the series of parallel lines in the drawing.

This upholstery fabric will normally have two sides, including a front side intended to be disposed on the outside of the pillow form of the device, where the front side may be viewed. The upholstery fabric will also normally have a back side, not intended for normal viewing. As will be discussed, the back side of the upholstery fabric will normally be at least loosely covered by the blanket fabric, thus forming a two layer (upholstery fabric-blanket fabric) structure in certain regions, so that absent certain seams or access ports, the back side of the upholstery fabric may be hidden even when the device is in the blanket configuration. The blanket fabric is drawn without the series of parallel lines (i.e. with a smooth uniform or blank appearance).

The blanket portion of the device (110) will, in a preferred embodiment, have at least one major side (either underside or top side), and preferably both major sides (e.g. underside and top side), comprising a plush fabric, or other fabric suitable for blankets. In a preferred embodiment, at least a part of one edge of the blanket portion (112) will be connected (this connection will be termed the "connected edge") to an interior edge of the pillow portion (102). This connected edge on the interior edge of the pillow portion will typically be on a side opposite to the zipper side (104) of the pillow portion.

Figures 1C, 1D:
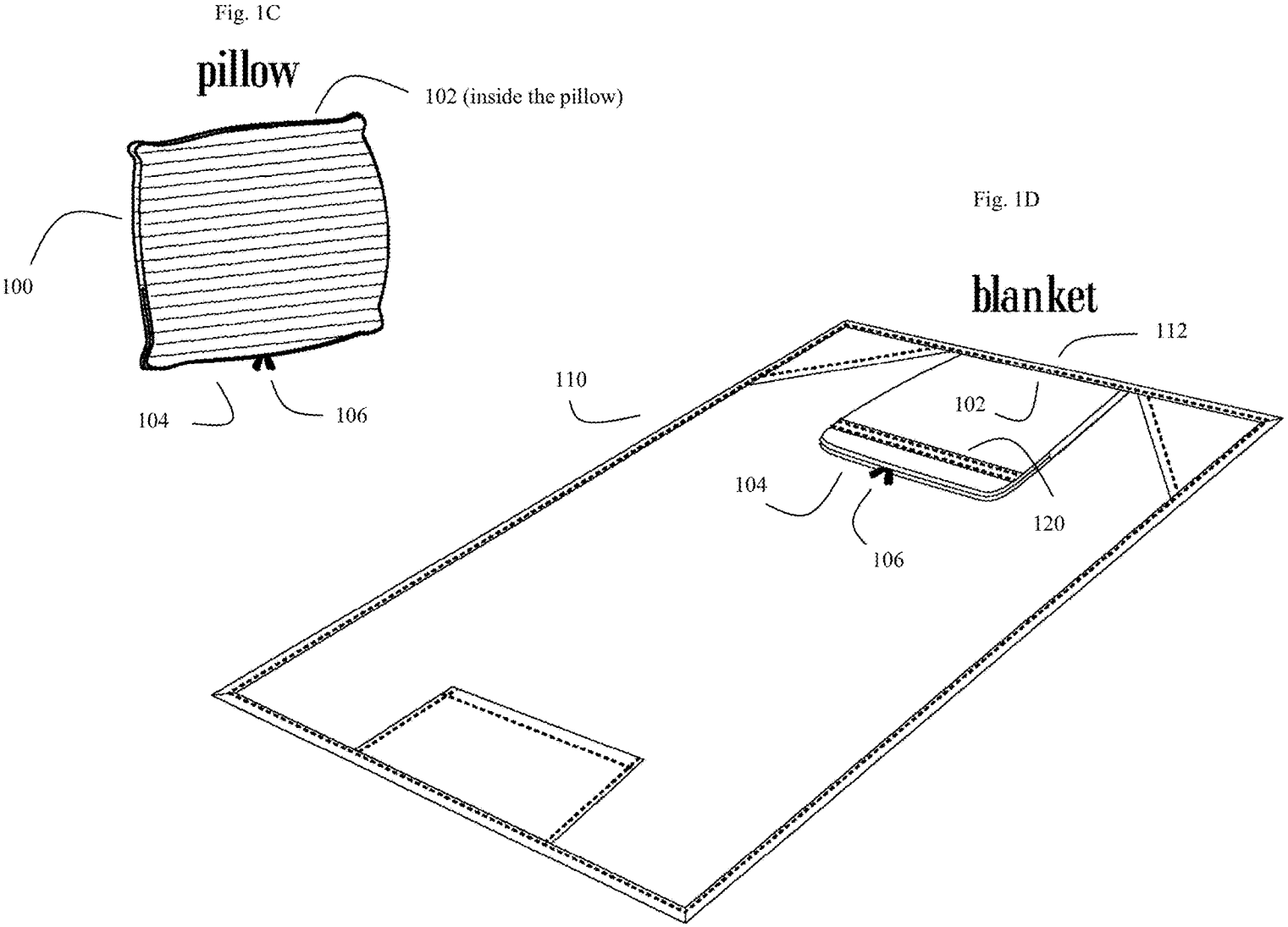
FIG. 1C shows an alternate form of the device in its first (pillow) configuration.
FIG. 1D shows an alternate form of the device in its second (blanket) configuration.

In some embodiments, it may be useful to provide a slit, seam, or opening in the device to, for example, allow the pillow from of the device to be more easily embroidered after initial production. In some embodiments, this may be done by providing a Velcro® or other type mechanical fastening device (e.g. other type hook and loop fastener, zipper, buttons or the like) to a portion of the device, such as on the blanket side of the pillow. This is shown as (120). In some embodiments, this seam may be invisible on the first pillow configuration of the device, as is shown in FIG. 1C, but may be seen as one or more seam lines or fastener lines (120), in the second (blanket) configuration of the device, as is shown in FIG. 1D.

Figures 2A, 2B, 2C, 2D, 2E, 2F, 2G:
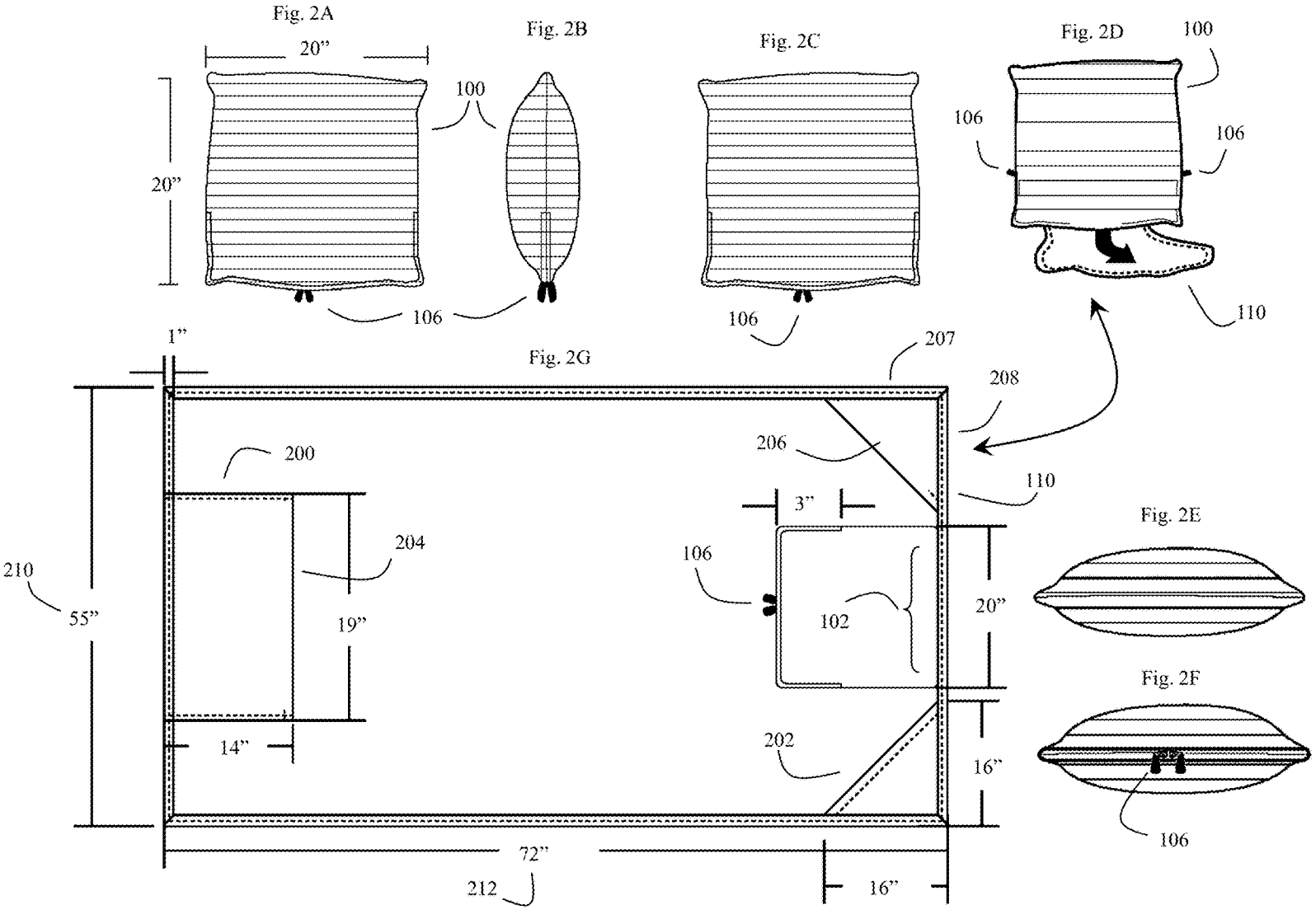
FIG. 2A shows the front of the pillow form of the device, along with typical dimensions.
FIG. 2B shows the side of the pillow form of the device.
FIG. 2C shows the back of the pillow form of the device.
FIG. 2D shows the front of the pillow device with the zippers open, with parts of the blanket portion of the device, previously stored interior to the pillow portion, now exposed.
FIG. 2E shows the top side of the pillow device.
FIG. 2F shows the bottom side of the pillow device.
FIG. 2G shows the device now fully unfolded in its second (blanket) configuration.

FIG. 2A shows the front of the pillow form of the device, along with typical dimensions. In this embodiment, the pillow portion may be an approximately square pillow with dimensions of about 20 inches by 20 inches, and this pillow may have a single zipper track (e.g. zipper tape, zipper rows of protruding teeth, zipper "flaps", or track of zipper elements) with two zipper heads (e.g. zipper sliders 106) originating from opposite sides of the zipper track. Note that in FIG. 2A, the device zipper heads (106) are shown in a closed configuration.

FIG. 2B shows the side of the pillow form of the device. The device zippers (106) are again closed.

FIG. 2C shows the back of the pillow form of the device. The device zippers (106) are again closed.

FIG. 2D shows the front of the pillow device (100) with the zippers (106) open, with parts of the blanket portion of the device (110), previously stored interior to the pillow portion, now exposed.

FIGS. 2E and 2F show the top and bottom of the pillow form of the device.

FIG. 2G shows the device now fully unfolded in its second (blanket) configuration (110), here the underside of the blanket is shown. This figure shows the optional foot pouch or "nook" (here in a rectangular shape 200) and optional two hand pouches or "nooks" (here both in a triangular shape 202). The device's zippers (106) and the inverted (e.g. inside out) interior of the pillow form of the device can also be seen. Some typical dimensions are also shown. In this embodiment, the blanket form of the device can be a rectangular blanket with outer dimensions such as 55 inches by 72 inches. The "connected edge" between the interior edge of the pillow portion and the part of the edge of the blanket portion is shown as (102).

Other dimensions may also be used. In a preferred embodiment, the pillow portion (100) may be a substantially square or rectangular shape with edge dimensions between 15 inches and 30 inches. The blanket portion of the device may also have a substantially rectangular shape with a first edge dimension (210) between 40 inches and 70 inches, and a second edge dimension (212) between 55 inches and 90 inches.

However other dimensions may also be used, and thus these dimensions are not intended to be limiting. More generally, the pillow portion will have a substantially square or rectangular shape with square or rectangular pillow edge dimensions, and the blanket portion will also have a substantially square or rectangular shape with square or rectangular blanket edge dimensions that exceed the dimensions of the square or rectangular pillow edge dimensions. Other dimensions, such as triangular shapes, circular shapes, irregular shapes, pentagonal shapes, and the like may also be used.

As is shown in more detail in FIG. 4A to 5I, the blanket portion and the pillow portion of the device will typically comprise dimensions and materials selected to enable, in a first configuration, the blanket portion (110) to be folded entirely inside the interior of the pillow portion (100) so that when the at least one zipper (106) is shut, the blanket portion is entirely inside the pillow portion leaving only the upholstery fabric on the exterior of the pillow portion. In this configuration, the blanket portion acts like stuffing for the pillow.

The blanket portion (110) and the pillow portion (100) will also typically comprise dimensions and materials selected to enable, in a second configuration, the pillow portion (100) to be inverted (turned inside out) exposing the interior of the pillow portion to the outside, and enabling the blanket portion (110) to be unfolded entirely outside the pillow portion. Note however that the blanket portion (110) remains attached to the pillow portion by at least the connected edge (102).

FIG. 3A shows a detail of a zipper head (106) that may be used in the device. In some embodiments, a double headed zipper may be used. In some embodiments, two zippers may also be used. Put alternatively, in some embodiments, the at least one zipper (106) can comprise at least one double headed zipper configured to be zipped from either the interior or exterior of the pillow portion.

FIG. 3B shows that in a preferred embodiment, the exterior of the first pillow configuration of the device may comprise upholstery fabric (e.g. cotton, polyester, burlap, or other natural or synthetic fabrics, preferably with the durability required for furniture cover use.

FIG. 3C shows another side view of the pillow form of the device.

FIG. 3D shows that in some embodiments, the device may employ two zippers, mounted at least one fabric zipper flap, which may extend across one complete side of the pillow portion of the device. In some embodiments, the zipper flap or flaps may further extend between 1 and 10 inches, or even farther, onto one or both opposite sides (300), (302) of the pillow proximate the at least one zipper side (104). More specifically, in some embodiments, the at least one zipper (106) can further extend between 1 and 10 inches or more onto two opposite sides (300, 302) of the pillow proximate the at least one zipper side (104).

In some embodiments, the at least one zipper can comprise at least two zipper heads, these two zipper heads disposed so that the zipper heads can be zipped together.

FIG. 3E shows another view of the front of the pillow device with the zippers (106) open, with parts of the blanket portion of the device (110), previously stored interior to the pillow portion, now exposed.

FIG. 3F shows another view ("underside") of the device now fully unfolded in its second (blanket) configuration (110), showing the optional foot pouch or "nook" (here in a rectangular shape 200) and optional two hand pouches or "nooks" (here both in a triangular shape 202). The device's zippers and the inverted interior of the pillow form of the device can also be seen. In a preferred embodiment, as previously discussed, the "inside" of the pillow portion of the device may be constructed from a plush fabric or other blanket fabric, such as a same plush fabric or other blanket fabric also used to cover the blanket portion of the device on one or both of the major sides. The hand pouches "nooks" and foot pouch "nook" may, in some embodiments, also be formed from the same type of plush fabric, blanket fabric, or other type fabric.

Referring also to FIG. 2G, the optional foot pouch or nook (200) can thus comprise a foot pouch disposed on an edge of the blanket portion opposite of the connected edge (102) and configured to accommodate the feet of a human user. The actual shape and dimensions of the foot pouch (200) may vary. In some embodiments, the foot pouch may have a rectangular shape with a first width dimension of 10 to 20 inches, and a second length dimension of between 15 to 30 inches. Here typical three sides of the foot pouch are attached (often by stitching) to the blanket portion, and one side (typically 204) will remain open to accommodate the user's feet.

Again referring also to FIG. 2G, similarly, with respect to the optional hand pouches or nooks (202), the device may in this embodiment be configured with one or two hand pouches (202) disposed on opposite corners of the blanket portion (110) where one edge of the opposite corners is common to both hand pouches, and this one edge also comprises the side with the connected edge (102), and the one or two hand pouches are configured (such as with an opening 206) to accommodate the hands of a human user.

Although the hand pouches (202) may be a variety of different shapes, in some embodiments, the hand pouches may have a triangular shape, where each triangular shape may have two corner edges attached (often by stitching) to the corresponding corners (207, 208) of the blanket portion (110).

FIG. 3G shows a view of the opposite major side ("top side") of the blanket form of the device, showing that in some embodiment, the opposite major side of the blanket form of the device may also be formed from plush fabric or other blanket fabric. In some embodiments, the various pouches may be formed by a stitching process, and in some embodiments, the stitch lines from this stitching process may be visible from the top side. In other embodiments, the stitch lines may not be visible, or a non-stitching process (e.g. adhesive or other bonding process) may be used to create the device.

FIG. 3H shows a detail of an edge of the blanket form of the device, showing that in some embodiments, the edge may be formed from fabric that has been folded over and then stitched together.

FIG. 3I shows a detail of a type of a zig-zag stitching pattern that may be used to form one or more edges of the blanket form of the device.

FIG. 3J shows a side view of the blanket form of the device, showing that the collapsed sides and zippers of the pillow form of the device, as well as the optional foot pouch (foot nook) and optional hand pouches (hand nooks) of the device are all exposed on the underside of the pillow form of the device.

FIG. 3K shows another view ("underside") of an alternative embodiment of the device now fully unfolded in its second (blanket) configuration, showing the location of at least one optional mechanical fastener (120), (122).

FIG. 3L shows a detail of at least one optional seam or mechanical fastener (here a hook and loop type mechanical fastener) which may be disposed on one or more locations in the device to facilitate embroidery of the pillow form of the device. This at least one optional seam or mechanical fastener (120, 122) is useful in order to facilitate customized embroidery of at least the pillow form of the device.

In manufacturing, it may be convenient to produce large production runs of the device without custom pillow form embroidering or other customization, and then later to designate certain units for subsequent customization such as by custom embroidering of the pillow portion. More specifically, it may be desired to embroider the device so that the front side of the upholstery fabric, which is visible in the pillow form of the device, has various custom designs.

However to do this, the embroiderers need easy access to the back side of the upholstery fabric to perform the embroidering stitching or other process. This access may not be easy to obtain, however, because when the device is fully formed, the backside of the upholstery fabric will normally be covered by the plush fabric used for the blanket, thus blocking access to the back side of the upholstery fabric.

Here use of optional seam (120, 122) allows the embroiderers at least temporarily move the plush blanket fabric away from the underside of the upholstery fabric, thus allowing various embroidering stitching or other processes to be done. This movement or separation process that at least partially separates the plush blanket fabric from the upholstery fabric is shown in FIG. 3L. Thus it may be useful, for example, to include optional seams (120, 122) at various locations. Useful locations include the zipper side of the device (e.g. near 106), or elsewhere (such as at 102). Alternatively optional seams may be placed in both places, or other places as desired.

Although various types of mechanical fasteners (e.g. Velcro®, or other hook and loop type fasteners, zippers, buttons, etc.) may be used for this at least one optional seam (120, 122), it should be remembered that this optional seam is generally only used once. Thus it may be useful to make the seam(s) inconspicuous. For this purpose, hook and loop type fasteners may be useful. In still other embodiments, once the custom embroidering is done, these optional seam(s) (120, 122) may be permanently closed (e.g. by stitching, adhesive, and the like).

FIG. 3M shows a view of the opposite major side ("top side") of an alternative embodiment of the blanket form of the device.

Various types of materials may be used to construct the device. Generally, however, breathable synthetic or natural fabrics are preferred, as these tend to be more comfortable than non-breathable fabrics. Since the exterior of the pillow portion of the device is intended for use as a supplemental item of furniture, as previously discussed, more robust fabrics, such as upholstery fabric comprises any of a cotton, polyester, or burlap fabric are preferred.

By contrast, since the blanket portion of the device is intended to be used as a blanket, as previously discussed, generally smoother and more comfortable fabrics, such as fabrics normally used in blankets, are preferred. These can include various plush fabrics, such as high nap silky plush fabric, and/or other fabrics such as wool, cotton, polyester, other synthetic fabrics, and the like.

Figure 4A:
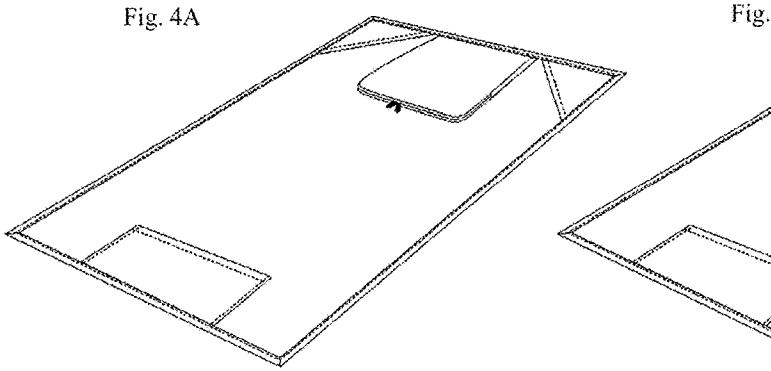
Figure 4B:
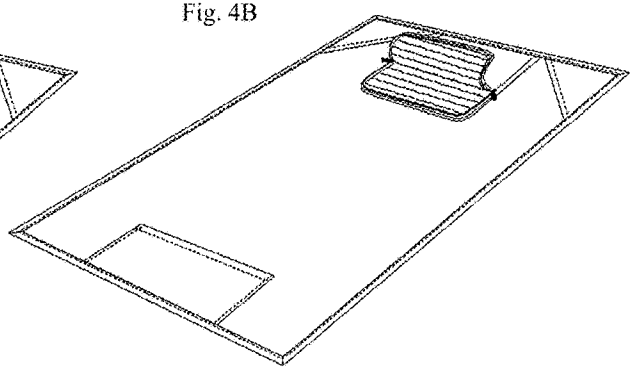
Figure 4C:
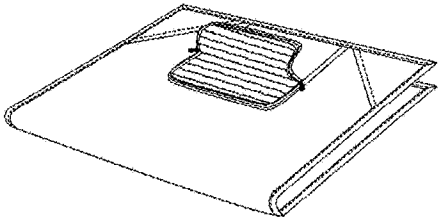
Figure 4D:
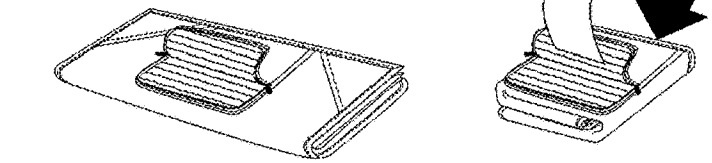
Figure 4E:
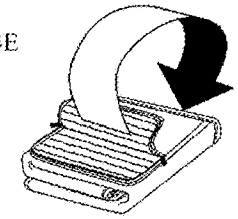
Figure 4F:
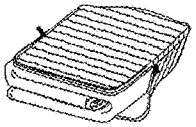
Figure 4G:
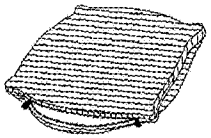
Figure 4H:
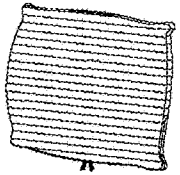

FIGS. 4A-4H show one process for converting the device from its second "blanket" configuration to the device's first "pillow" configuration. The device is completely in its second "blanket" configuration in FIG. 4A, and the zippers are shut. In FIG. 4B, the zippers are unzipped, in FIG. 4C, the process of folding the blanket portion of the device commences. This folding process continues in FIG. 4D. In FIG. 4E, the sides of what will become the exterior of the pillow form of the device are inverted (turned inside out), effectively surrounding the folded blanket with the upholstery fabric that will now form the exterior of the pillow form of the device. This process extends further in FIG. 4G and in 4H, after the zippers are now shut; the device is entirely in its first "pillow" configuration.

Figure 5C:
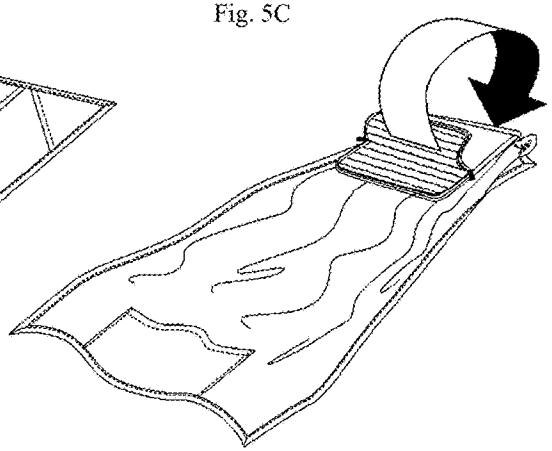
Figure 5B:
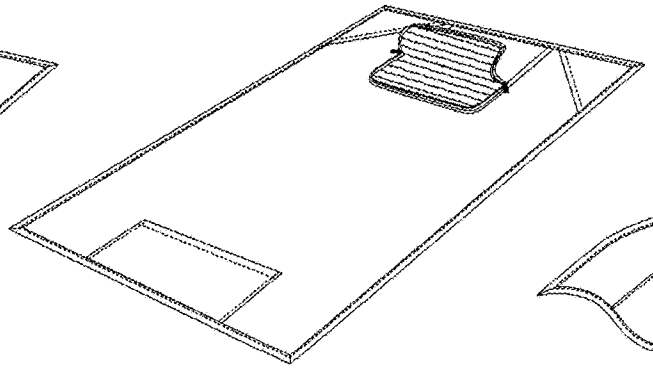
Figure 5A:
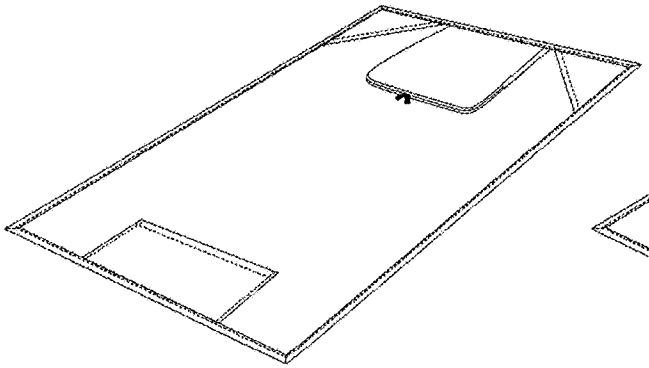
Figure 5I:
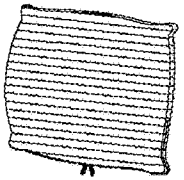
Figure 5H:
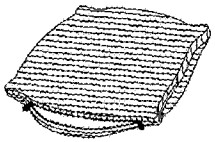
Figure 5D:
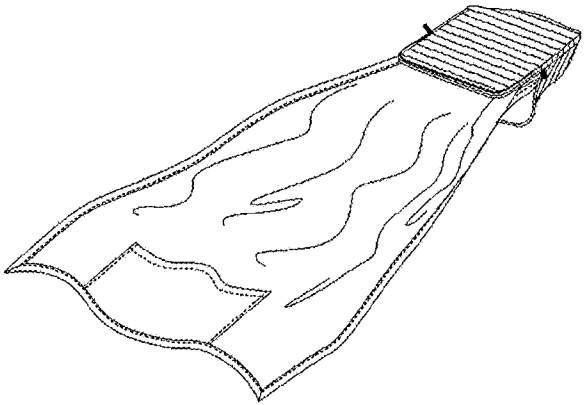

FIGS. 5A-5D and 5H-5I shows an alternative process for converting the device from its second "blanket" configuration to the device's first "pillow" configuration. Here again, the device is fully in the second "blanket" configuration in FIG. 5A, the zipper(s) are again opened in FIG. 5B, but the pillow sides of the device are now inverted (turned inside out) sooner in FIG. 5C, and the remainder of the blanket is then stuffed inside the pillow sides in FIG. 5D. In FIG. 5H and FIG. 5I, the zipper is again shut, resulting in the device being entirely in its first "pillow" configuration in FIG. 5I.

Figure 6B:
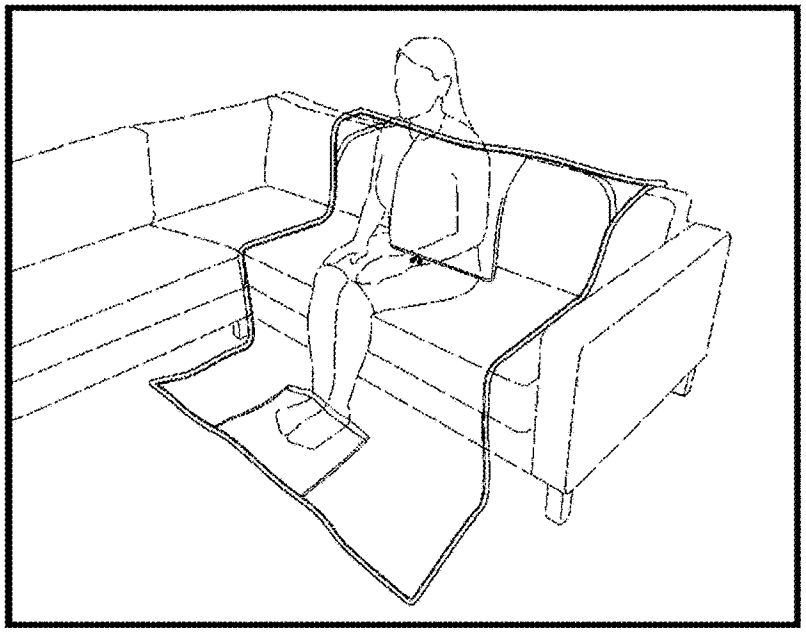
Figure 6A:
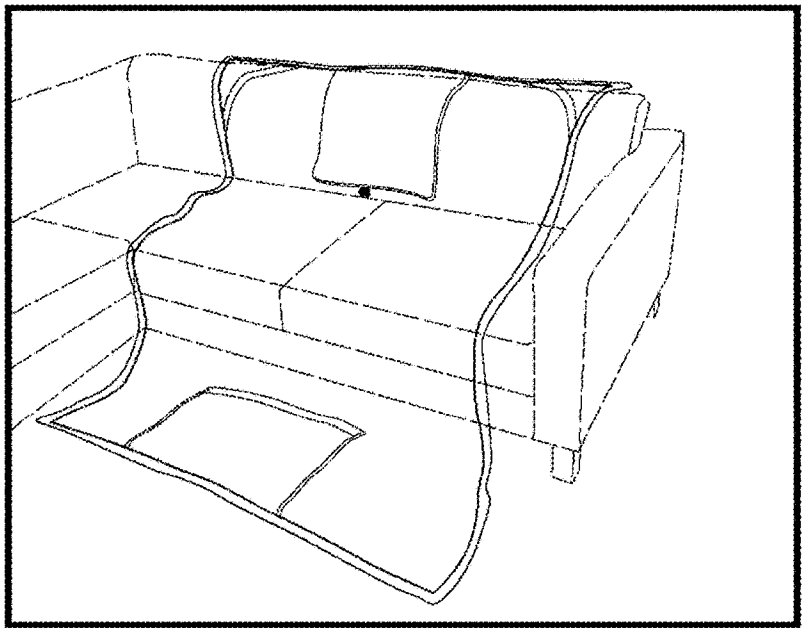
Figure 6D:
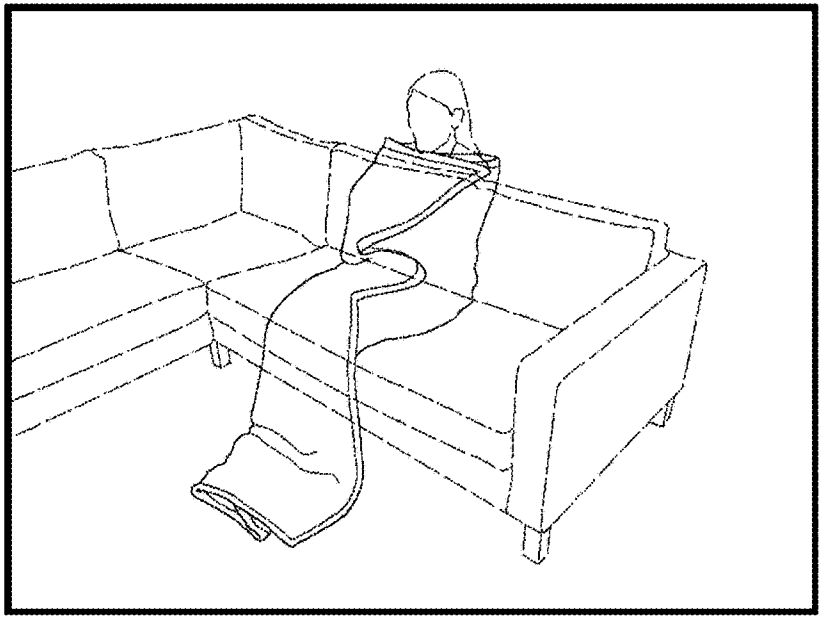
Figure 6C:
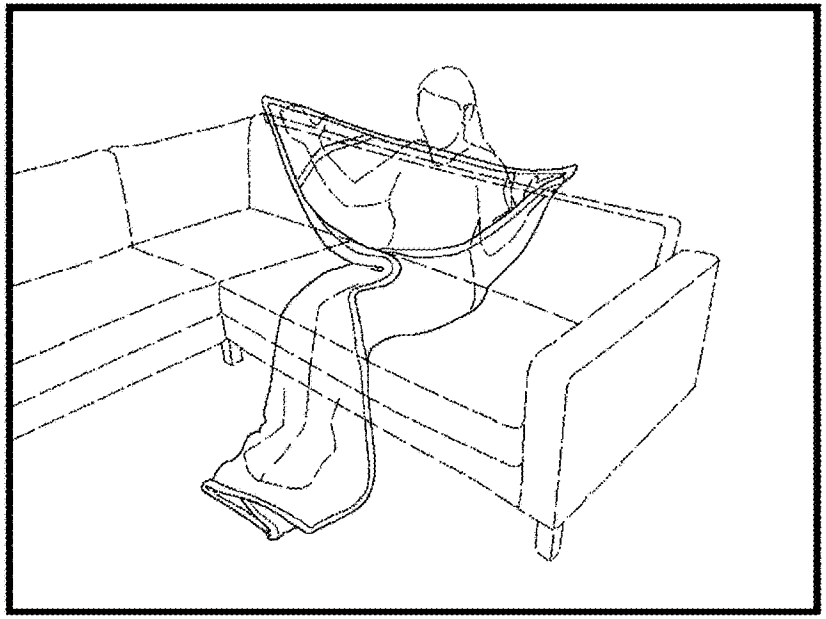

FIGS. 6A-6D show how the device may be used as a blanket when the device is in the second "blanket" configuration. Here in FIG. 6A, the blanket form of the device is shown on top of a couch, and for ease of visualization, the blanket is shown as if it was transparent. In FIG. 6B, a human user is positioned below the blanket, with her feet inside the optional foot pouch. In FIG. 6C, the user has extended her arms into the two optional hand pouches. In FIG. 6D, the user has now folded her arms, thus covering herself with the blanket form of the device.

FIG. 7 shows a human user using the blanket form of the device while lying down.

FIG. 8 shows how the device, in the first "pillow" configuration, has a design that is intended to match standard furniture pillows and upholstery.

The device is intended to also have certain decorative aspects as well, and some of these various decorative aspects are shown in FIGS. 9 to 16.

FIGS. 9A-9L show that the exterior upholstery side of the first "pillow" configuration of the device may be configured with a large number of alternative decorative designs and color configurations.

FIGS. 10A-10L show that the exterior upholstery side of the first "pillow" configuration of the device may be configured with a large number of other alternative decorative designs and color configurations.

FIGS. 11A-11L show that the exterior upholstery side of the first "pillow" configuration of the device may be configured with a large number of other alternative decorative designs and color configurations.

FIGS. 12A-12L show that the exterior upholstery side of the first "pillow" configuration of the device may be configured with a large number of other alternative decorative designs and color configurations.

FIGS. 13A-13D show that the underside of topside of the second "blanket" configuration of the invention may also be configured with a large number of other alternative decorative designs and color configurations.

FIGS. 14A-14D show that the underside of topside of the second "blanket" configuration of the invention may also be configured with a large number of other alternative decorative designs and color configurations.

FIGS. 15A-15D show that the underside of topside of the second "blanket" configuration of the invention may also be configured with a large number of other alternative decorative designs and color configurations.

FIGS. 16A-16D show that the underside of topside of the second "blanket" configuration of the invention may also be configured with a large number of other alternative decorative designs and color configurations.

Velcro® is a trademark of Velcro Industries B.V.

The invention claimed is:

1. A convertible pillow and blanket device, said device comprising:

a pillow portion with an interior, an exterior, and at least one zipper extending along a zipper side of said pillow portion, wherein said at least one zipper further extends between 1 and 10 inches onto two opposite sides of said pillow adjacent to and proximate said zipper side, thus creating zipper flaps that extend partially along sides of the pillow that are adjacent said zipper side, said exterior of said pillow portion comprising upholstery fabric and configured to the dimensions of an upholstery cushion;

a blanket portion, at least one side of said blanket portion comprising a plush fabric, wherein an edge of said blanket portion is connected by connected edge to an interior edge of said pillow portion on a side opposite to said zipper side;

said blanket portion and said pillow portion having dimensions selected to enable, in a first configuration, said blanket portion to be folded entirely inside the interior of said pillow portion so that when said at least one zipper is shut, said blanket portion is entirely inside said pillow portion leaving only said upholstery fabric on said exterior of said pillow portion;

said blanket portion and said pillow portion having dimensions selected to enable, in a second configuration, said pillow portion to be inverted exposing the interior of said pillow portion to the outside, and enabling said blanket portion to be unfolded entirely outside said pillow portion remaining attached to said pillow portion by said connected edge; and a foot pouch different from said pillow portion, said foot pouch disposed on an edge of said blanket portion opposite of said connected edge and configured to accommodate the feet of a human user.

2. The device of claim 1, wherein said pillow portion has a substantially square or rectangular shape with square or rectangular pillow edge dimensions, and wherein said blanket portion also has a substantially square or rectangular shape with square or rectangular blanket edge dimensions that exceed the dimensions of said square or rectangular pillow edge dimensions.

3. The device of claim 2, wherein said pillow portion has a substantially square shape with edge dimensions between 15 inches and 30 inches, and wherein said blanket portion has a substantially rectangular shape with a first edge dimension between 40 inches and 70 inches, and a second edge dimension between 55 inches and 90 inches.

4. The device of claim 1, wherein said at least one zipper comprises at least one double headed zipper configured to be zipped from either the interior or exterior of said pillow portion.

5. The device of claim 1, wherein said at least one zipper comprises at least two zipper heads, disposed so that said at least two zipper heads can be zipped together, said zipper heads extending on zipper flaps that extend at least partially along adjacent sides of said pillow.

6. The device of claim 1, wherein said foot pouch has a rectangular shape with a first width dimension of 10 to 20 inches, and a second length dimension of between 15 to 30 inches, and wherein three sides of said foot pouch are attached to said blanket portion.

7. The device of claim 1, further configured with two hand pouches disposed on opposite corners of said blanket portion on a same side of said blanket portion as said pillow portion, where one edge of said opposite corners is common to both hand pouches, and said one edge also comprises said connected edge, said two hand pouches configured to accommodate the hands of a human user.

8. The device of claim 7, wherein said hand pouches have a triangular shape, each triangular shape having with two corner edges attached to the corners of said blanket portion.

9. The device of claim 1, wherein said upholstery fabric comprises any of a cotton, polyester, or burlap fabric.

10. The device of claim 1, wherein said plush fabric comprises a silky plush fabric.

11. The device of claim 1, further providing at least one seam or mechanical fastener configured to at least temporarily allow said plush fabric to be moved away from said upholstery fabric, and to facilitate access to the back side of said upholstery fabric.

12. The device of claim 11, wherein said at least one seam or mechanical fastener comprises at least one hook and loop type fastener configured to enable said pillow portion to be more easily embroidered after initial production, and further configured to be invisible when said device is in said first configuration.

13. A convertible pillow and blanket device, said device comprising:

a pillow portion with an interior, an exterior, and at least one zipper extending along at least one zipper side of said pillow portion, said exterior of said pillow portion comprising upholstery fabric and configured to the dimensions of an upholstery cushion;

a blanket portion, at least one side of said blanket portion comprising a plush fabric, wherein an edge of said blanket portion is connected by connected edge to an interior edge of said pillow portion on a side opposite to said zipper side;

said blanket portion and said pillow portion having dimensions selected to enable, in a first configuration, said blanket portion to be folded entirely inside the interior of said pillow portion so that when said at least one zipper is shut, said blanket portion is entirely inside said pillow portion leaving only said upholstery fabric on said exterior of said pillow portion; and said blanket portion and said pillow portion having dimensions selected to enable, in a second configuration, said pillow portion to be inverted exposing the interior of said pillow portion to the outside, and enabling said blanket portion to be unfolded entirely outside said pillow portion remaining attached to said pillow portion by said connected edge;

wherein said at least one zipper comprises at least two zipper heads, disposed so that said at least two zipper heads can be zipped together, said zipper heads extending on zipper flaps that extend at least partially along adjacent sides of said pillow;

further comprising a foot pouch different from said pillow portion, said foot pouch disposed on an edge of said blanket portion opposite of said connected edge and configured to accommodate the feet of a human user;

further configured with two hand pouches disposed on opposite corners of said blanket portion on a same side of said blanket portion as said pillow portion, where one edge of said opposite corners is common to both hand pouches, and said one edge also comprises said connected edge, said two hand pouches configured to accommodate the hands of a human user.

14. The device of claim 13, further providing at least one seam or mechanical fastener configured to at least temporarily allow said plush fabric to be moved away from said upholstery fabric, and to facilitate access to the back side of said upholstery fabric;

wherein said at least one seam or mechanical fastener comprises at least one hook and loop type fastener configured to enable said pillow portion to be more easily embroidered after initial production, and further configured to be invisible when said device is in said first configuration.

* * * * *